US010678171B2

(12) United States Patent
Furuichi et al.

(10) Patent No.: US 10,678,171 B2
(45) Date of Patent: Jun. 9, 2020

(54) FIXING DEVICE AND IMAGE FORMING APPARATUS

(71) Applicants: Yuusuke Furuichi, Kanagawa (JP); Yukimichi Someya, Saitama (JP); Tomoya Adachi, Kanagawa (JP)

(72) Inventors: Yuusuke Furuichi, Kanagawa (JP); Yukimichi Someya, Saitama (JP); Tomoya Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/263,634

(22) Filed: Jan. 31, 2019

(65) Prior Publication Data

US 2019/0286026 A1 Sep. 19, 2019

(30) Foreign Application Priority Data

Mar. 14, 2018 (JP) ..... 2018-046610
Dec. 19, 2018 (JP) ..... 2018-237462

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/2064* (2013.01); *G03G 15/5004* (2013.01); *G03G 2215/2032* (2013.01)

(58) Field of Classification Search
CPC ..... G03G 15/2053; G03G 15/2064; G03G 15/2042; G03G 15/5004; G03G 2215/2032
See application file for complete search history.

(56) References Cited

U.S. PATENT DOCUMENTS 5,528,345 A * 6/1996 Hasegawa ..... G03G 15/2064 219/216
9,529,309 B2 12/2016 Ishii et al.
2012/0177420 A1 7/2012 Shimokawa et al.

FOREIGN PATENT DOCUMENTS

EP 2177955 A1 4/2010
JP 2008-107761 5/2008
JP 2008-140701 6/2008
JP 2015004918 A 1/2015
JP 2016-090606 5/2016
JP 2018-017877 2/2018

OTHER PUBLICATIONS

Extended European Search Report dated Sep. 6, 2019 for EP Application No. 19154851.0.

* cited by examiner

*Primary Examiner* — Susan S Lee
(74) *Attorney, Agent, or Firm* — Harness, Dickey & Pierce P.L.C.

(57) ABSTRACT

A fixing device includes a heater including a heat generator that is divided into a plurality of heat generating portions in an axial direction of the endless belt. The heat generator defines a dividing region between adjacent ones of the plurality of heat generating portions and a non-dividing region other than the dividing region. A primary guide contacts and guides the endless belt. The primary guide is disposed opposite the dividing region of the heat generator and has a first thermal capacity. A secondary guide contacts and guides the endless belt. The secondary guide is disposed opposite the non-dividing region of the heat generator and has a second thermal capacity that is greater than the first thermal capacity.

30 Claims, 15 Drawing Sheets

FIXING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2018-046610, filed on Mar. 14, 2018, and 2018-237462, filed on Dec. 19, 2018, in the Japan Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing an image on a recording medium and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes the image on the recording medium. The fixing device employs a belt method using an endless belt.

The fixing device may include a heater that heats the belt and is divided into a plurality of heating portions in a width direction of the belt. Alternatively, the fixing device may include a plurality of film guides serving as a guide that guides the belt.

SUMMARY

This specification describes below an improved fixing device. In one embodiment, the fixing device includes an endless belt that rotates in a rotation direction and an opposed rotator that contacts an outer circumferential surface of the endless belt to form a nip between the endless belt and the opposed rotator. A heater contacts an inner circumferential surface of the endless belt. The heater includes a heat generator that is divided into a plurality of heat generating portions in an axial direction of the endless belt. The heat generator defines a dividing region between adjacent ones of the plurality of heat generating portions and a non-dividing region other than the dividing region. A primary guide contacts the inner circumferential surface of the endless belt and guides the endless belt. The primary guide is disposed opposite the dividing region of the heat generator and has a first thermal capacity. A secondary guide contacts the inner circumferential surface of the endless belt and guides the endless belt. The secondary guide is disposed opposite the non-dividing region of the heat generator and has a second thermal capacity that is greater than the first thermal capacity.

This specification further describes an improved fixing device. In one embodiment, the fixing device includes an endless belt that rotates in a rotation direction. An opposed rotator contacts an outer circumferential surface of the endless belt to form a nip between the endless belt and the opposed rotator. A heater contacts an inner circumferential surface of the endless belt. The heater includes a heat generator that is divided into a plurality of heat generating portions in an axial direction of the endless belt. The heat generator defines a dividing region between adjacent ones of the plurality of heat generating portions and a non-dividing region other than the dividing region. A primary guide contacts the inner circumferential surface of the endless belt in a first contact area and guides the endless belt. The primary guide is disposed opposite the dividing region of the heat generator. A secondary guide contacts the inner circumferential surface of the endless belt in a second contact area that is greater than the first contact area and guides the endless belt. The secondary guide is disposed opposite the non-dividing region of the heat generator.

This specification further describes an improved fixing device. In one embodiment, the fixing device includes an endless belt that rotates in a rotation direction. An opposed rotator contacts an outer circumferential surface of the endless belt to form a nip between the endless belt and the opposed rotator. A heater contacts an inner circumferential surface of the endless belt. The heater includes a heat generator that is divided into a plurality of heat generating portions in an axial direction of the endless belt. The heat generator defines a dividing region between adjacent ones of the plurality of heat generating portions and a non-dividing region other than the dividing region. A primary guide contacts the inner circumferential surface of the endless belt and guides the endless belt. A secondary guide contacts the inner circumferential surface of the endless belt and guides the endless belt. Each of the primary guide and the secondary guide is disposed at one of an upstream position upstream from the heater and a downstream position downstream from the heater in the rotation direction of the endless belt. Each of the primary guide and the secondary guide is disposed within an axial span of the endless belt and shifted from a center of the dividing region in the axial direction of the endless belt.

This specification further describes an improved image forming apparatus. In one embodiment, the image forming apparatus includes the fixing device described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 9 is a partially enlarged cross-sectional view of the heat generator depicted in

FIG. 8;

Figure 1:
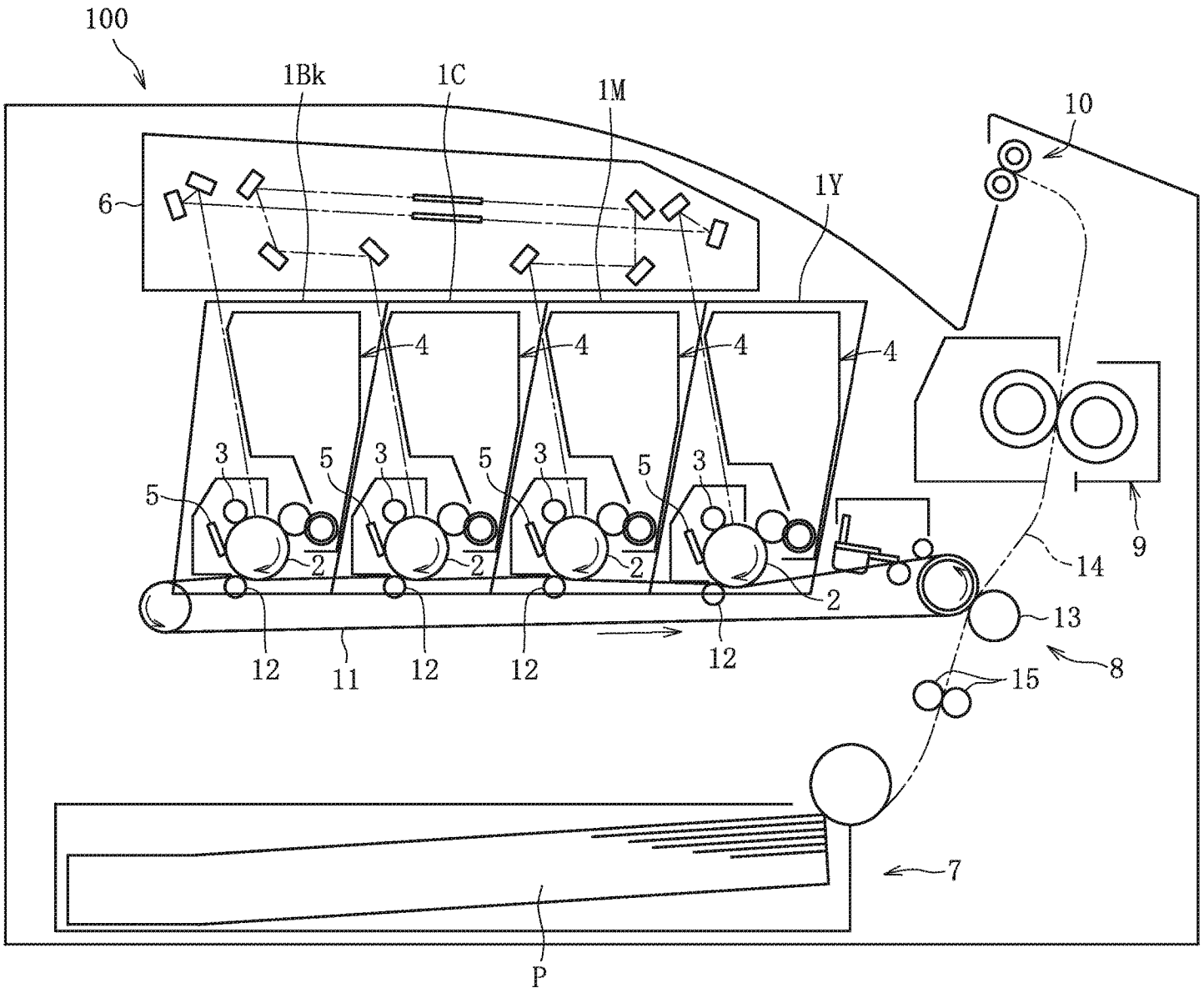
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 is explained.

The image forming apparatus 100 may be a copier, a facsimile machine, a printer, a multifunction peripheral or a multifunction printer (MFP) having at least two of copying, printing, scanning, facsimile, plotter, and other functions, or the like. According to this embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

Referring to the attached drawings, the following describes a construction of the image forming apparatus 100 according to embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure.

As illustrated in FIG. 1, the image forming apparatus 100 includes four image forming units 1Y, 1M, 1C, and 1Bk that are removably installed in a body of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the sheet P is conveyed to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
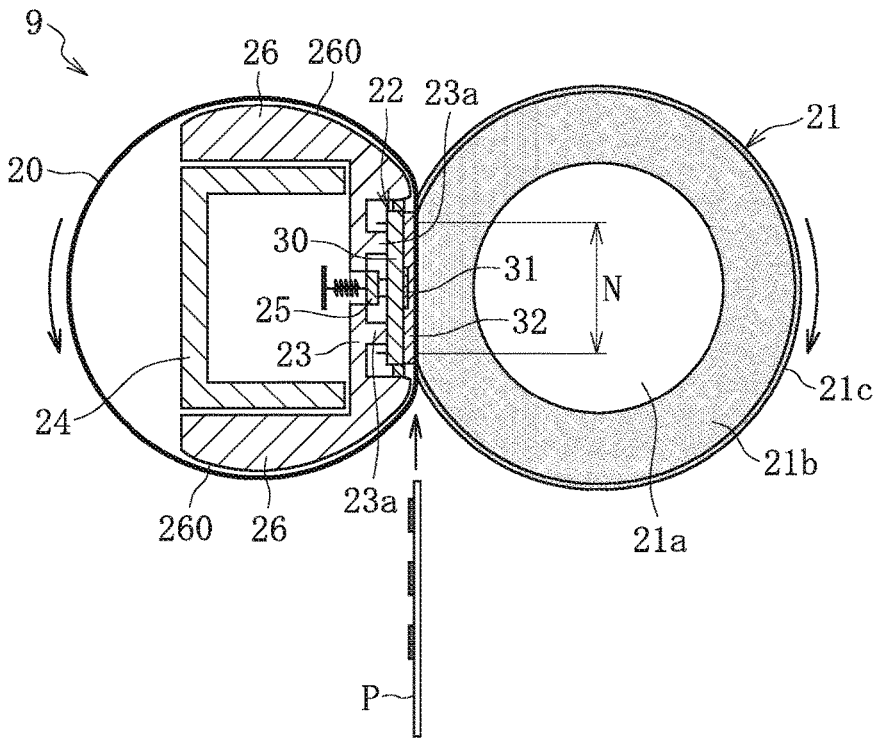
FIG. 2 is a schematic cross-sectional view of a fixing device according to a first embodiment of the present disclosure, that is incorporated in the image forming apparatus depicted in FIG. 1.

FIG. 2 is a schematic cross-sectional view of the fixing device 9. As illustrated in FIG. 2, the fixing device 9 according to this embodiment includes a fixing belt 20, a pressure roller 21, a heater 22, a heater holder 23, a stay 24, and a thermistor 25. The fixing belt 20 is an endless belt. The pressure roller 21 serves as an opposed rotator or an opposed member that contacts an outer circumferential surface of the fixing belt 20 to form a fixing nip N between the fixing belt 20 and the pressure roller 21. The heater 22 serves as a heater or a heating member that heats the fixing belt 20. The heater holder 23 serves as a holder that holds the heater 22. The stay 24 serves as a support that supports the heater holder 23. The thermistor 25 serves as a temperature detector that detects the temperature of the fixing belt 20.

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* coats the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member biases the pressure roller 21 toward the fixing belt 20, pressing the pressure roller 21 against the heater 22 via the fixing belt 20. Thus, the fixing nip N is formed between the fixing belt 20 and the pressure roller 21. A driver drives and rotates the pressure roller 21. As the pressure roller 21 rotates in a rotation direction indicated by an arrow in FIG. 2, the fixing belt 20 is driven and rotated by the pressure roller 21.

A detailed description is now given of a construction of the heater 22.

The heater 22 is a laminated heater that extends in a longitudinal direction thereof throughout the fixing belt 20 in a width direction, that is, an axial direction, of the fixing belt 20. The heater 22 includes a base 30 that is platy, a resistive heat generator 31 that is disposed on the base 30, and an insulating layer 32 that coats the resistive heat generator 31. The insulating layer 32 of the heater 22 contacts the inner circumferential surface of the fixing belt 20. Heat generated by the resistive heat generator 31 is conducted to the fixing belt 20 through the insulating layer 32.

According to this embodiment, the resistive heat generator 31 and the insulating layer 32 are interposed between the base 30 and the fixing belt 20 at the fixing nip N. Alternatively, the resistive heat generator 31 and the insulating layer 32 may be interposed between the base 30 and the heater holder 23. In this case, since heat generated by the resistive heat generator 31 is conducted to the fixing belt 20 through the base 30, the base 30 is preferably made of a material having an increased thermal conductivity such as aluminum nitride. As the base 30 is made of the material having the increased thermal conductivity, even if the resistive heat generator 31 is disposed opposite the fixing belt 20 via the base 30, the resistive heat generator 31 heats the fixing belt 20 sufficiently through the base 30.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side plates of the fixing device 9, respectively. Since the stay 24 supports the heater holder 23 and the heater 22 supported by the heater holder 23, in a state in which the pressure roller 21 is pressed against the fixing belt 20, the heater 22 receives pressure from the pressure roller 21 precisely to form the fixing nip N stably.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP), the heater holder 23 suppresses conduction of heat thereto from the heater 22, heating the fixing belt 20 effectively. In order to decrease a contact area where the heater holder 23 contacts the heater 22 and thereby reduce an amount of heat conducted from the heater 22 to the heater holder 23, the heater holder 23 includes projections 23*a* that contact the base 30 of the heater 22. According to this embodiment, the projections 23*a* of the heater holder 23 do not contact a back face of the base 30 at a part of the base 30 where the base 30 mounts the resistive heat generator 31, that is, a part of the base 30, which is susceptible to temperature increase, thus decreasing the amount of heat conducted to the heater holder 23 further and heating the fixing belt 20 effectively.

Figure 3:
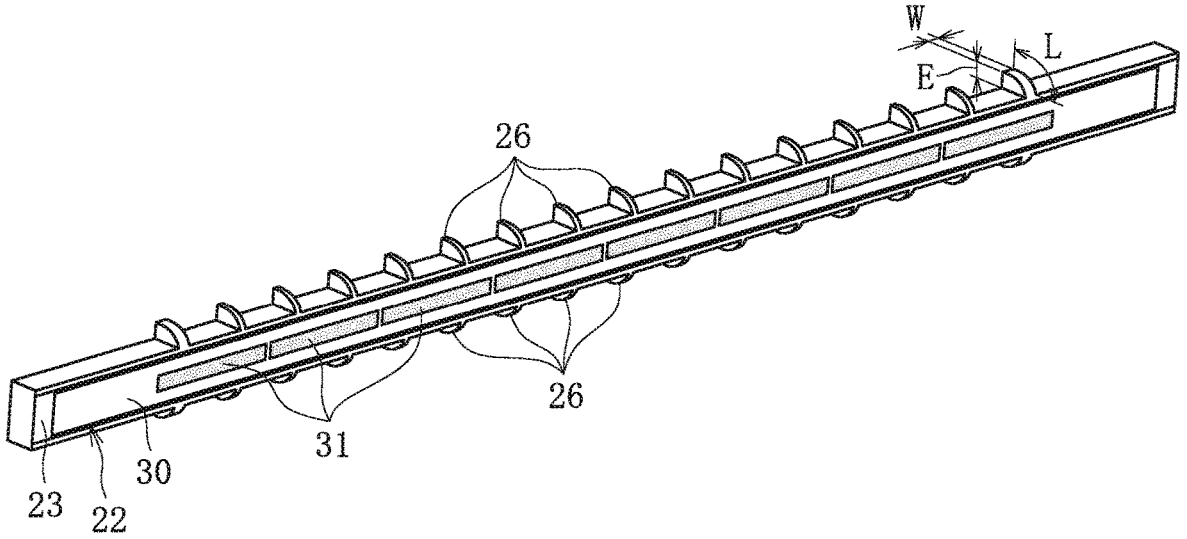
FIG. 3 is a perspective view of a heater, a heater holder, and guides incorporated in the fixing device depicted in FIG. 2.

The heater holder 23 mounts guides 26 that guide the fixing belt 20. The guides 26 are disposed upstream from and below the heater 22 in FIG. 2 and downstream from and above the heater 22 in FIG. 2, respectively, in a rotation direction of the fixing belt 20. FIG. 3 is a perspective view of the heater 22, the heater holder 23, and the guides 26. As illustrated in FIG. 3, the plurality of guides 26 disposed upstream and downstream from the heater 22 in the rotation direction of the fixing belt 20 is aligned in the longitudinal direction of the heater 22, that is, the width direction of the fixing belt 20, with an interval between adjacent ones of the guides 26. Each of the guides 26 is substantially fan-shaped. As illustrated in FIG. 2, each of the guides 26 includes a belt opposing face 260 that is disposed opposite the inner circumferential surface of the fixing belt 20 and defines an arc or a curved projection that extends in a circumferential direction of the fixing belt 20. As illustrated in FIG. 3, according to this embodiment, each of the guides 26 disposed at both lateral ends of the heater 22 in the longitudinal direction thereof has a width W that is greater than a width W of each of other guides 26. Other than this, each of the guides 26 has a width W, a length L (e.g., a circumferential length) in the circumferential direction of the fixing belt 20, and a height E, which are common.

In the fixing device 9 according to this embodiment, when printing starts, the driver drives and rotates the pressure roller 21 and the fixing belt 20 starts rotation in accordance with rotation of the pressure roller 21. Since the inner circumferential surface of the fixing belt 20 is contacted and guided by the belt opposing face 260 of each of the guides 26, the fixing belt 20 rotates stably and smoothly. Additionally, as power is supplied to the resistive heat generators 31 of the heater 22, the heater 22 heats the fixing belt 20. In a state in which the temperature of the fixing belt 20 reaches a predetermined target temperature (e.g., a fixing temperature), as the sheet P bearing the unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 4:
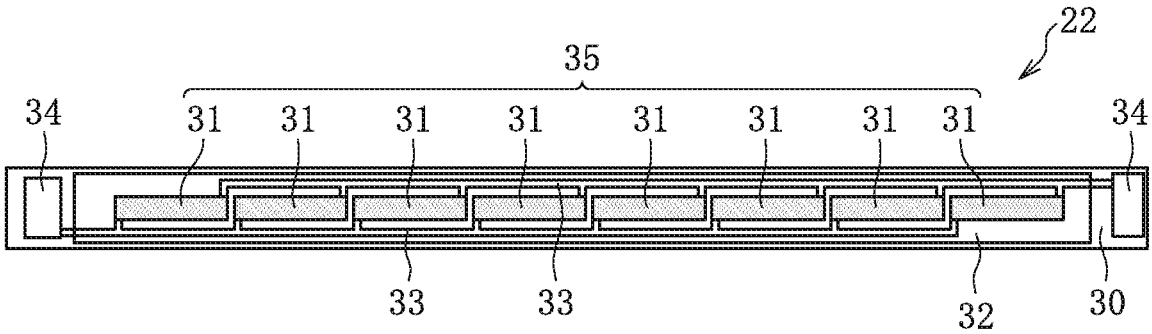
FIG. 4 is a plan view of the heater depicted in FIG. 3.

FIG. 4 is a plan view of the heater 22 according to this embodiment.

As illustrated in FIG. 4, the heater 22 according to this embodiment includes the plurality of resistive heat generators 31 arranged in the longitudinal direction of the heater 22, that is, the width direction of the fixing belt 20, with an interval between adjacent ones of the resistive heat generators 31. In other words, a heat generator 35 is divided into a plurality of portions in the width direction of the fixing belt 20, that is, the plurality of resistive heat generators 31. The resistive heat generators 31 are electrically connected in parallel to a pair of electrodes 34 through feeders 33. The electrodes 34 are disposed at both lateral ends of the base 30 in a longitudinal direction thereof. The feeders 33 are made of a conductor having a resistance value smaller than a resistance value of the resistive heat generators 31.

A gap between adjacent ones of the resistive heat generators 31 is 0.2 mm or greater preferably and 0.4 mm or greater more preferably to attain insulation between the resistive heat generators 31. If the gap between the adjacent ones of the resistive heat generators 31 is excessively great, the gap may be susceptible to temperature decrease. Accordingly, in order to suppress variation in temperature of the heater 22 in the longitudinal direction thereof, the gap is 5 mm or smaller preferably and 1 mm or smaller more preferably.

The resistive heat generators 31 are made of a material having a positive temperature coefficient (PTC) property that is characterized in that the resistance value increases, that is, a heater output decreases, as the temperature increases.

Accordingly, if a sheet P having a narrow width that is smaller than an entire width of the heat generator 35 is conveyed through the fixing device 9, for example, since the sheet P does not draw heat from the fixing belt 20 in an outboard span that is outboard from the sheet P in the width direction of the fixing belt 20, the resistive heat generators 31 in the outboard span are subject to temperature increase. Since a constant voltage is applied to the resistive heat generators 31, when the temperature of the resistive heat generators 31 in the outboard span increases and the resistance value thereof increases, conversely, an output (e.g., a heat generating amount) from the resistive heat generators 31 decreases relatively, suppressing temperature increase of the resistive heat generators 31 that are disposed at both lateral ends of the heat generator 35 in a longitudinal direction thereof. Additionally, the plurality of resistive heat generators 31 is electrically connected in parallel, suppressing temperature increase in a non-conveyance span where the sheet P is not conveyed while retaining the printing speed. Alternatively, the heat generator 35 may include heat generators other than the resistive heat generators 31 having the PTC property. The heat generators may be arranged in a plurality of columns in a short direction of the heater 22.

For example, the resistive heat generators 31 are produced as below. Silver-palladium (AgPd), glass powder, and the like are mixed into paste. The paste coats the base 30 by screen printing or the like. Thereafter, the base 30 is subject to firing. According to this embodiment, the resistive heat generators 31 have a resistance value of 80Ω at an ambient temperature. Alternatively, the resistive heat generators 31 may be made of a resistive material such as a silver alloy (AgPt) and ruthenium oxide ($RuO_2$). The feeders 33 and the electrodes 34 are made of a material prepared with silver (Ag) or silver-palladium (AgPd) by screen printing or the like.

The base 30 is preferably made of ceramic, such as alumina and aluminum nitride, or a nonmetallic material, such as glass and mica, which has an increased heat resistance and an increased insulation. According to this embodiment, the base 30 is made of alumina and has a short width of 8 mm, a longitudinal width of 270 mm, and a thickness of 1.0 mm. Alternatively, the base 30 may include a conductive layer made of metal or the like and an insulating layer disposed on the conductive layer. Preferably, the metal is aluminum, stainless steel, or the like that is available at reduced costs. In order to improve evenness of heat generated by the heater 22 so as to enhance quality of an image formed on a sheet P, the base 30 may be made of a material that has an increased thermal conductivity such as copper, graphite, and graphene.

For example, the insulating layer 32 is made of heat resistant glass and has a thickness of 75 micrometers. The insulating layer 32 covers the resistive heat generators 31 and the feeders 33 and insulates and protects the resistive heat generators 31 and the feeders 33 while retaining smooth sliding of the fixing belt 20 over the heater 22.

Figure 5:
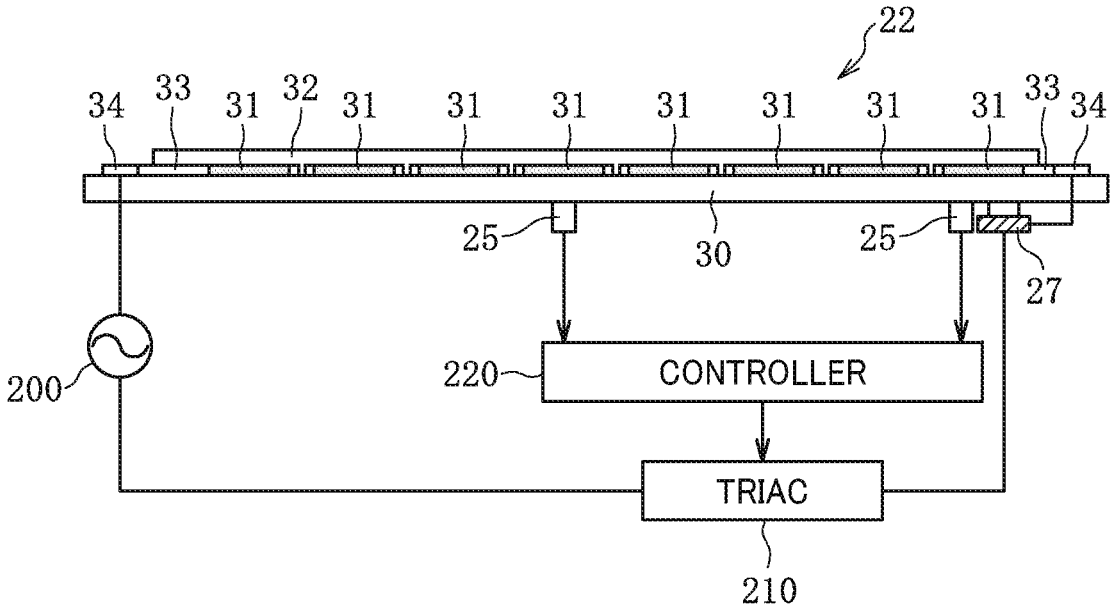
FIG. 5 is a diagram of the heater depicted in FIG. 4 and a power supply circuit that supplies power to the heater.

FIG. 5 is a diagram of the heater 22 according to this embodiment, illustrating a power supply circuit that supplies power to the heater 22.

As illustrated in FIG. 5, according to this embodiment, the power supply circuit for supplying power to each of the resistive heat generators 31 is constructed by electrically connecting an alternating current power supply 200 to the electrodes 34 of the heater 22. The power supply circuit includes a triac 210 that controls an amount of power supplied to each of the resistive heat generators 31. A controller 220 controls the amount of power supplied to each of the resistive heat generators 31 through the triac 210 based on a temperature of the resistive heat generator 31, that is detected by the thermistor 25 serving as a temperature detector. The controller 220 includes a microcomputer that includes a central processing unit (CPU), a read-only memory (ROM), a random access memory (RAM), and an input-output (I/O) interface.

According to this embodiment, the thermistors 25 serving as temperature detectors are disposed opposite a center span of the heater 22 in the longitudinal direction thereof, that is, a minimum sheet conveyance span where a minimum size sheet P is conveyed, and one lateral end span of the heater 22 in the longitudinal direction thereof, respectively. Further, a thermostat 27 serving as a power interrupter is disposed opposite one end of the heater 22 in the longitudinal direction thereof. The thermostat 27 interrupts supplying power to the resistive heat generators 31 when a temperature of the resistive heat generator 31 is a predetermined temperature or higher. The thermistors 25 and the thermostat 27 contact the back face of the base 30, which is opposite a front face of the base 30, which mounts the resistive heat generators 31, to detect the temperature of the resistive heat generators 31.

Figure 6:
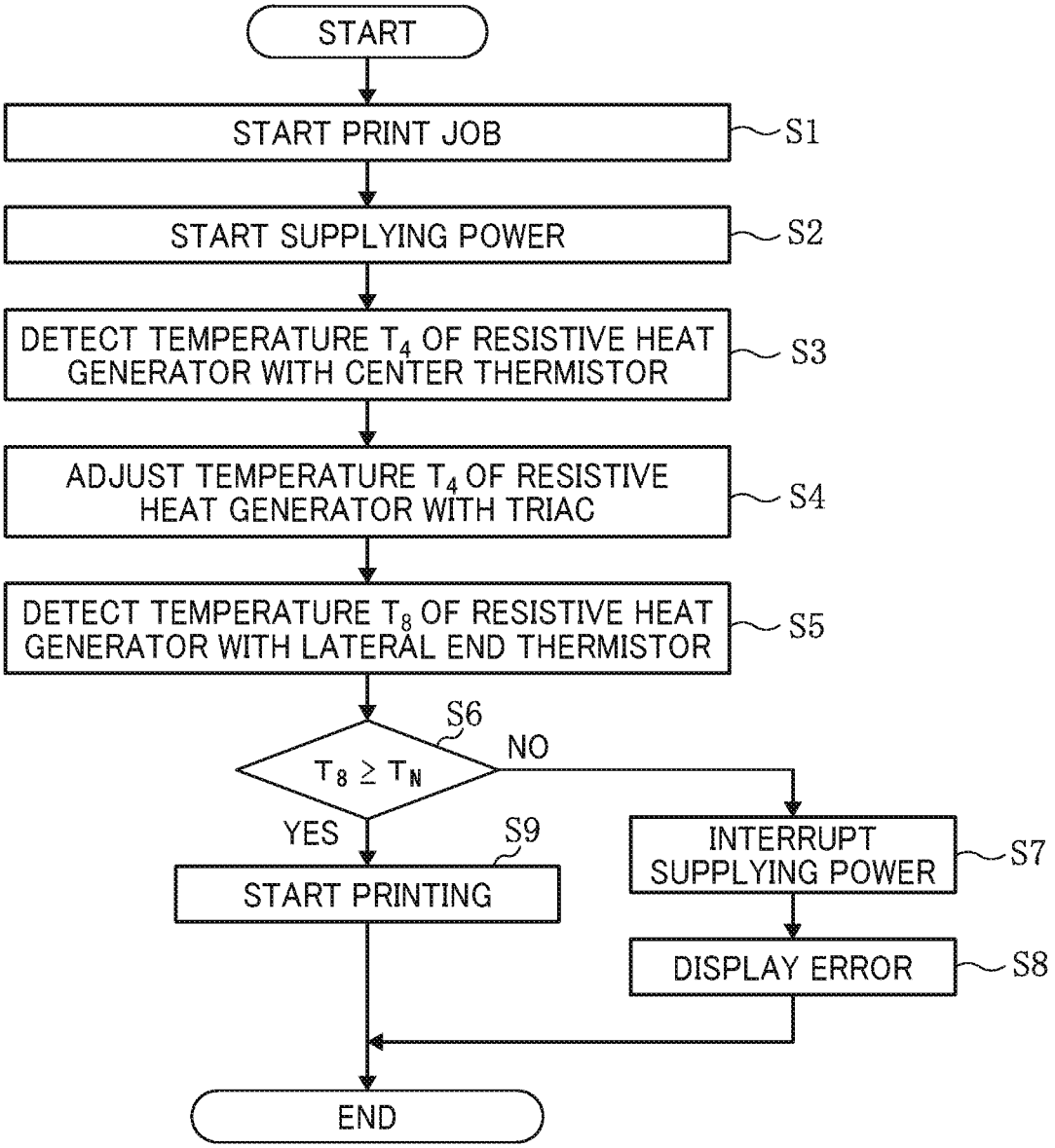
FIG. 6 is a flowchart illustrating control processes for controlling the heater depicted in FIG. 5.

Referring to FIG. 6 illustrating a flowchart, a description is provided of control processes for controlling the heater 22 according to this embodiment.

As illustrated in FIG. 6, in step S1, the image forming apparatus 100 starts a print job. In step S2, the controller 220 causes the alternating current power supply 200 to start supplying power to each of the resistive heat generators 31 of the heater 22. Accordingly, each of the resistive heat generators 31 starts generating heat, heating the fixing belt 20. In step S3, the thermistor 25, that is, a center thermistor, disposed opposite the center span of the heater 22 in the longitudinal direction thereof, detects a temperature $T_4$ of the resistive heat generator 31 disposed in the center span of the heater 22 in the longitudinal direction thereof. In step S4, based on the temperature $T_4$ sent from the thermistor 25, that is, the center thermistor, the controller 220 controls the triac 210 to adjust the amount of power supplied to each of the resistive heat generators 31 so that each of the resistive heat generators 31 attains a predetermined temperature.

Simultaneously, in step S5, the thermistor 25, that is, a lateral end thermistor, disposed opposite the lateral end span of the heater 22 in the longitudinal direction thereof also detects a temperature $T_8$ of the resistive heat generator 31 disposed in the lateral end span of the heater 22 in the longitudinal direction thereof. In step S6, the controller 220 determines whether or not the temperature $T_8$ of the resistive heat generator 31, that is detected by the thermistor 25 serving as the lateral end thermistor, is a predetermined temperature $T_N$ or higher ($T_8 \geq T_N$). If the controller 220 determines that the temperature $T_8$ of the resistive heat generator 31 is lower than the predetermined temperature $T_N$ (NO in step S6), the controller 220 determines that an abnormally decreased temperature (e.g., disconnection) occurs and interrupts supplying power to the heater 22 in step S7. In step S8, the controller 220 causes a control panel of the image forming apparatus 100 to display an error. Conversely, if the controller 220 determines that the temperature $T_8$ of the resistive heat generator 31, that is detected by the thermistor 25, is the predetermined temperature $T_N$ or higher (YES in step S6), the controller 220 determines that no abnormally decreased temperature occurs and starts printing in step S9.

If the controller 220 does not perform temperature control based on the temperature detected by the thermistor 25, that is, the center thermistor, due to breakage, disconnection, or the like of the resistive heat generator 31, the resistive heat generator 31 disposed in the lateral end span of the heater 22 in the longitudinal direction thereof and other resistive heat generators 31 may suffer from an abnormally increased temperature. In this case, when the temperature of the resistive heat generators 31 reaches the predetermined temperature or higher, the controller 220 activates the thermostat 27 to interrupt supplying power to the resistive heat generators 31, preventing the resistive heat generators 31 from suffering from the abnormally increased temperature.

If the fixing belt 20 that is thin is employed like in the fixing device 9 according to this embodiment, since the fixing belt 20 has a decreased thermal capacity, the temperature of a surface of the fixing belt 20 is subject to an influence by a distribution in a heat generation amount of the heater 22. Accordingly, with the heat generator 35 divided into the plurality of resistive heat generators 31 throughout the fixing belt 20 in the width direction thereof like in the fixing device 9 according to this embodiment, the temperature of the fixing belt 20 tends to decrease in the interval (e.g., a dividing region) between adjacent ones of the resistive heat generators 31 into which the heat generator 35 is divided.

Additionally, with a configuration in which the guides 26 guide the fixing belt 20 like in the fixing device 9 according to this embodiment, the guides 26 draw heat from the fixing belt 20. Hence, the temperature of the fixing belt 20 tends to decrease in a guide span where the guides 26 are disposed.

Figure 7:
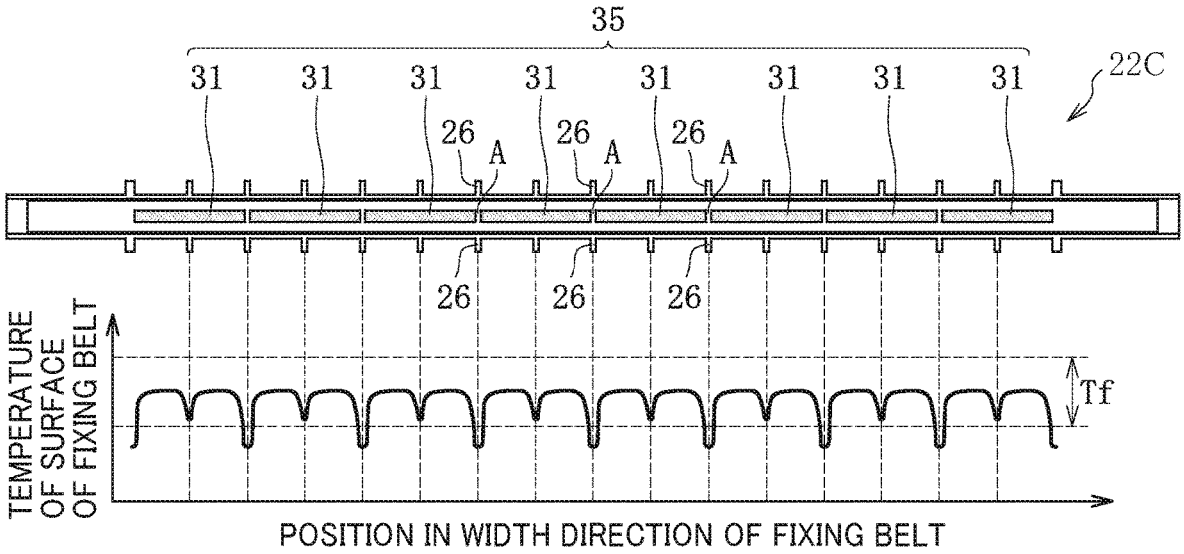
FIG. 7 is a diagram of a heater as a comparative example.

Accordingly, like a comparative example illustrated in FIG. 7, with a configuration in which a dividing region A of the heat generator 35 overlaps the guide 26 in the width direction of the fixing belt 20 in an overlap region, the heat generator 35 suffers from temperature decrease caused by the dividing region A as well as conduction of heat to the guide 26, causing the fixing belt 20 from suffering from substantial temperature decrease.

FIG. 7 is a diagram of a heater 22C as a comparative example. FIG. 7 illustrates a graph below the heater 22C. The graph illustrates measurement results obtained with a thermo viewer that measures the temperature of the surface of the fixing belt 20 when power of 500 W is supplied to the heater 22C for 4 seconds. A horizontal axis of the graph represents the position in the width direction of the fixing belt 20. According to the measurement results of the comparative example depicted in FIG. 7, with the heater 22C, the temperature of the fixing belt 20 decreases substantially in the overlap region where the dividing region A of the heat generator 35 overlaps the guide 26, and is lower than a desired fixing temperature range Tf. Under this condition, when a sheet P of A4 size in portrait orientation is conveyed for printing, fixing failure occurs.

As a method to prevent the fixing failure as described above, the heater 22C may heat the fixing belt 20 for an extended period of time before the sheet P is conveyed through the fixing nip N, for example, so that the temperature of the fixing belt 20 increases throughout the fixing belt 20 in the width direction thereof. However, the method increases a warmup time taken to heat the fixing belt 20 to a predetermined target temperature, increasing consumption of power disadvantageously. Further, when the temperature of the fixing belt 20 increases entirely, an allowance to an upper limit of the fixing temperature decreases, causing failure such as hot offset in which the fixing belt 20 supplies heat to the sheet P excessively.

A description is provided of a configuration of a first comparative fixing device and a second comparative fixing device.

The first comparative fixing device includes a heater that heats an endless belt and is divided into a plurality of heating portions in a width direction of the belt. The second comparative fixing device includes a plurality of film guides serving as a guide that guides the belt.

In order to attain an appropriate fixing property to fix the toner image on the recording medium, the temperature of the belt heated by the heater is preferably even throughout the belt in the width direction thereof.

However, if the divided heating portions of the first comparative fixing device are employed, an amount of heat supplied to the belt from an interval between adjacent ones of the divided heating portions is smaller than an amount of heat supplied to the belt from the divided heating portions. Accordingly, a temperature of a portion of the belt, that is disposed opposite the interval, may be lower than a temperature of another portion of the belt, that is disposed opposite the divided heating portions.

In the second comparative fixing device, the film guides draw heat from the belt partially. Accordingly, a portion of the belt, from which the film guides draw heat, may suffer from temperature decrease.

Thus, in the first comparative fixing device including the divided heating portions and the second comparative fixing device including the film guides, a part of the belt in the width direction thereof may suffer from temperature decrease.

Figure 8:
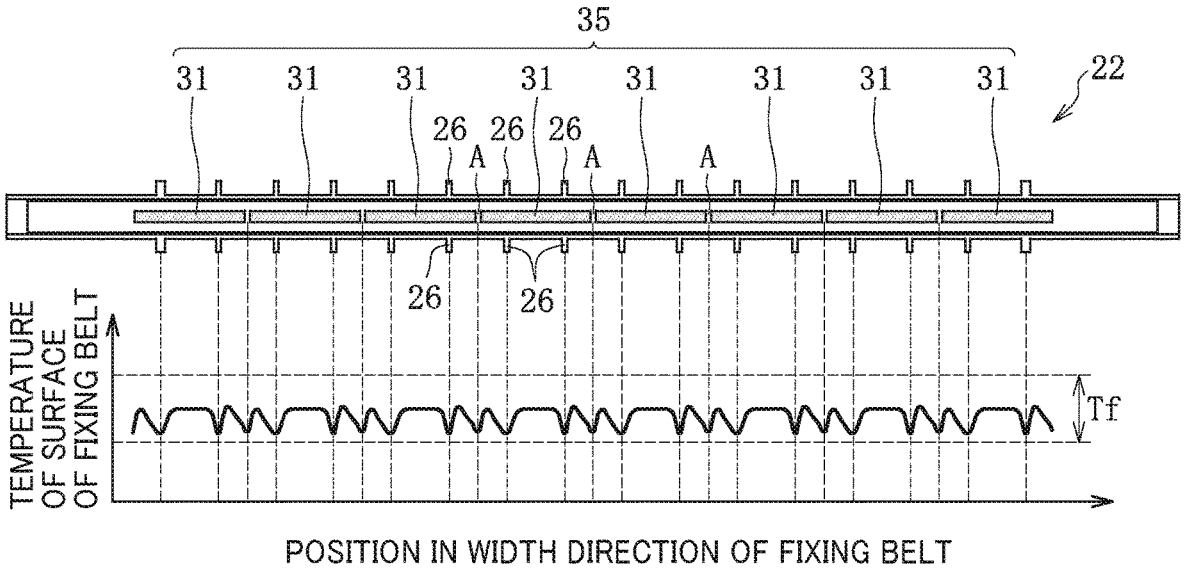
FIG. 8 is a diagram of the heater depicted in FIG. 5, illustrating a dividing region of a heat generator that is shifted from the guide.

To address those circumstances, as illustrated in FIG. 8, in the fixing device 9 according to this embodiment, the dividing region A of the heat generator 35 is shifted from the guide 26 in the width direction of the fixing belt 20, suppressing partial temperature decrease of the fixing belt 20. FIG. 8 is a diagram of the heater 22, illustrating the dividing region A of the heat generator 35 that is shifted from the guide 26.

According to the embodiment illustrated in FIG. 8, no guide 26 is disposed opposite a position corresponding to the dividing region A of the heat generator 35 (e.g., a circumferential region of the fixing belt 20, that encompasses the dividing region A). Since the guides 26 guide the fixing belt 20, the guides 26 are disposed at least within a width span (e.g. an axial span) of the fixing belt 20 in the width direction thereof. Hence, each of the guides 26 is disposed within the width span of the fixing belt 20 and disposed at a position outside or shifted from the position corresponding to the dividing region A of the heat generator 35.

FIG. 8 illustrates a graph illustrating measurement results obtained by measuring the temperature of the surface of the fixing belt 20 heated by the heater 22 according to this embodiment. A measurement condition for the measurement results depicted in FIG. 8 is similar to that for the measurement results of the comparative example depicted in FIG. 7. According to the measurement results depicted in FIG. 8, the temperature of the fixing belt 20 decreases at positions in the width direction of the fixing belt 20 where the fixing belt 20 is disposed opposite the guides 26 and at positions in the width direction of the fixing belt 20 where the fixing belt 20 is disposed opposite the dividing regions A of the heat generator 35. However, the temperature of the fixing belt 20 does not decrease substantially unlike the comparative example of the fixing belt 20 heated by the heater 22C depicted in FIG. 7. As a result, the temperature of the fixing belt 20 is within the desired fixing temperature range Tf throughout the fixing belt 20 in the width direction thereof, attaining the appropriate fixing property. It is because the dividing region A of the heat generator 35 is shifted from the guide 26 in the width direction of the fixing belt 20, suppressing local temperature decrease of the fixing belt 20, which occurs when the dividing region A of the heat generator 35 overlaps the guide 26 like the comparative example illustrated in FIG. 7 and thereby reducing a maximum amount of decrease in the temperature of the fixing belt 20.

As described above, according to this embodiment, even if the fixing belt 20 is not heated for the extended period of time to increase the temperature of the fixing belt 20 entirely, since the dividing region A of the heat generator 35 is shifted from the guide 26 in the width direction of the fixing belt 20, local temperature decrease of the fixing belt 20 is suppressed. Thus, the fixing belt 20 is not heated for the extended period of time, preventing extension of the warmup time, increase in consumption of power, hot offset, and the like, and attaining the appropriate fixing property.

Figure 9:
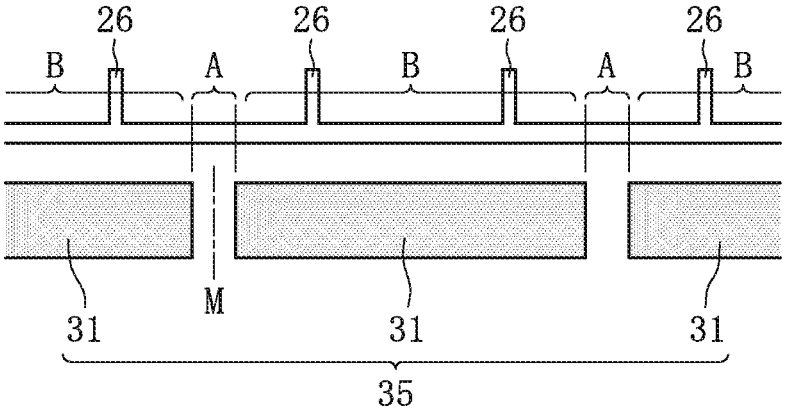

FIG. 9 is a partially enlarged cross-sectional view of the heat generator 35 depicted in FIG. 8. As illustrated in FIG. 9, a dividing region of the heat generator 35 denotes the dividing region A in the width direction of the fixing belt 20. The dividing region A encompasses an entire interval between adjacent ones of the resistive heat generators 31 into which the heat generator 35 is divided. According to this embodiment, the dividing region A is parallel to the short direction of the heater 22 and extended vertically in FIG. 9.

Figure 10:
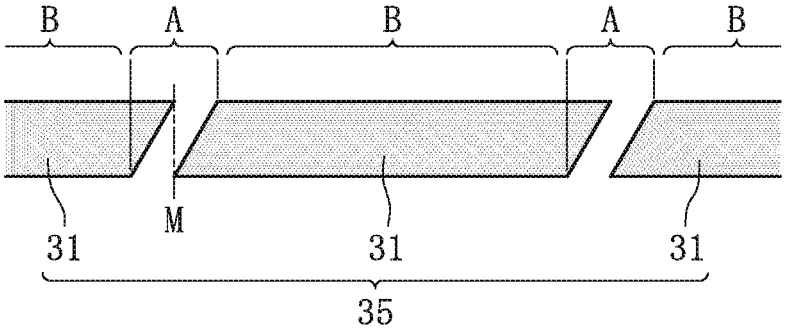
FIG. 10 is a partially enlarged cross-sectional view of the heat generator depicted in FIG. 8, illustrating the dividing region that is inclined.

Alternatively, the dividing region A may be inclined relative to the short direction of the heater 22 as illustrated in FIG. 10. FIG. 10 is a partially enlarged cross-sectional view of the heat generator 35, illustrating the dividing region A that is inclined.

Figure 11:
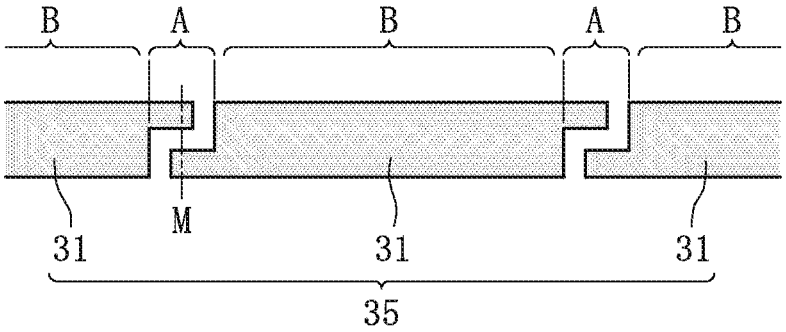
FIG. 11 is a partially enlarged cross-sectional view of the heat generator depicted in FIG. 8, illustrating the dividing region that is bent.

Yet alternatively, the dividing region A may be bent in the longitudinal direction of the heater 22 at a middle portion of the dividing region A in the short direction of the heater 22 as illustrated in FIG. 11. FIG. 11 is a partially enlarged cross-sectional view of the heat generator 35, illustrating the dividing region A that is bent.

Figure 12:
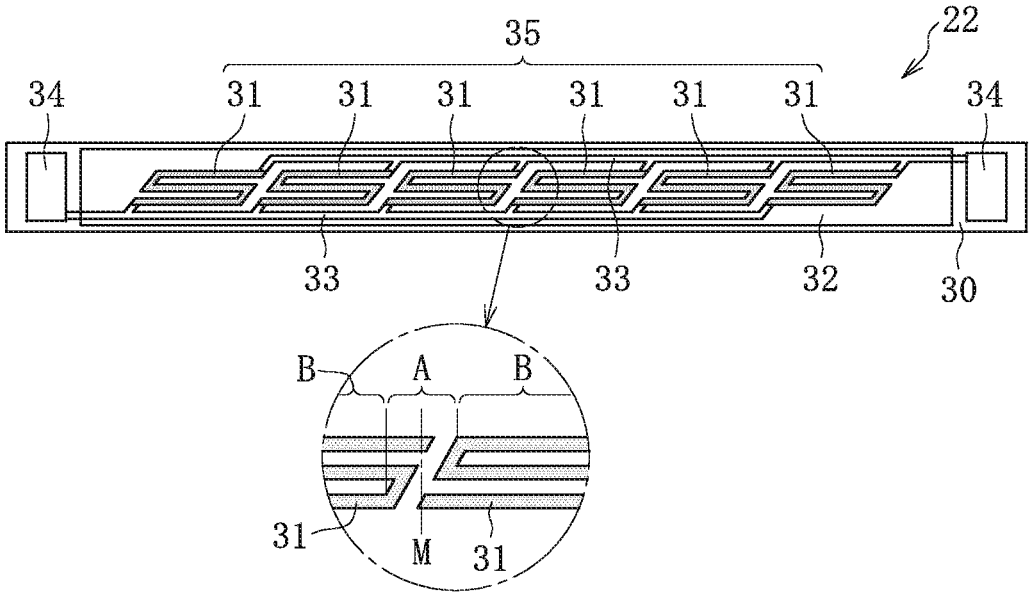
FIG. 12 is a plan view of the heat generator depicted in FIG. 8, illustrating a resistive heat generator incorporated therein, which is turned at a plurality of positions.

Yet alternatively, as illustrated in FIG. 12, the resistive heat generator 31 may be turned at a plurality of positions to have a plurality of turned portions.

In examples depicted in FIGS. 10, 11, and 12 also, the dividing region of the heat generator 35 denotes the dividing region A in the width direction of the fixing belt 20. The dividing region A encompasses the entire interval between the adjacent ones of the resistive heat generators 31 into which the heat generator 35 is divided, as described above. Hereinafter, a region of the heat generator 35 other than the dividing region A in the width direction of the fixing belt 20 defines a non-dividing region B.

Also in examples illustrated in FIGS. 10, 11, and 12, like a configuration illustrated in FIG. 9, the guide 26 is disposed at a position other than the position corresponding to the dividing region A of the heat generator 35, suppressing remarkable local temperature decrease of the fixing belt 20.

As described above, the temperature of the fixing belt 20 tends to decrease at the position corresponding to the dividing region A of the heat generator 35. Especially, the temperature of the fixing belt 20 tends to decrease most remarkably at a position corresponding to a center position M of the dividing region A in the width direction of the fixing belt 20 as illustrated in FIGS. 9 to 12. Hence, in order to reduce the maximum amount of decrease in the temperature of the fixing belt 20, the guide 26 is not disposed opposite at least the center position M of the dividing region A in the width direction of the fixing belt 20.

Figure 13:
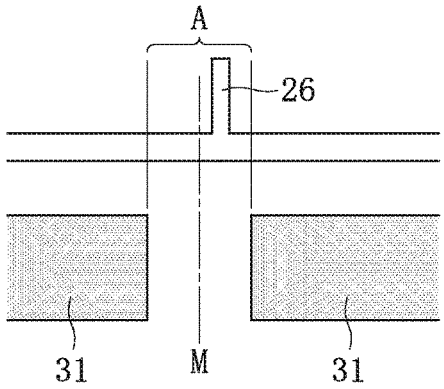
FIG. 13 is a cross-sectional view of the guide depicted in FIG. 3 that is disposed opposite the dividing region.

In other words, if the guide 26 is not disposed opposite the center position M of the dividing region A in the width direction of the fixing belt 20, the maximum amount of decrease in the temperature of the fixing belt 20 is expected to decrease advantageously. Hence, the guide 26 is disposed at least at a position outside or shifted from the position corresponding to the center position M of the dividing region A in the width direction of the fixing belt 20. If this condition is satisfied, like an example illustrated in FIG. 13, the guide 26 may be disposed opposite a position within the dividing region A, that is, a part of the dividing region A. FIG. 13 is a cross-sectional view of the guide 26 disposed opposite the dividing region A. However, in order to decrease the maximum amount of decrease in the temperature of the fixing belt 20 effectively, like the embodiments described above, the guide 26 is preferably disposed at the position other than the position corresponding to the dividing region A or the entire dividing region A.

Figure 14:
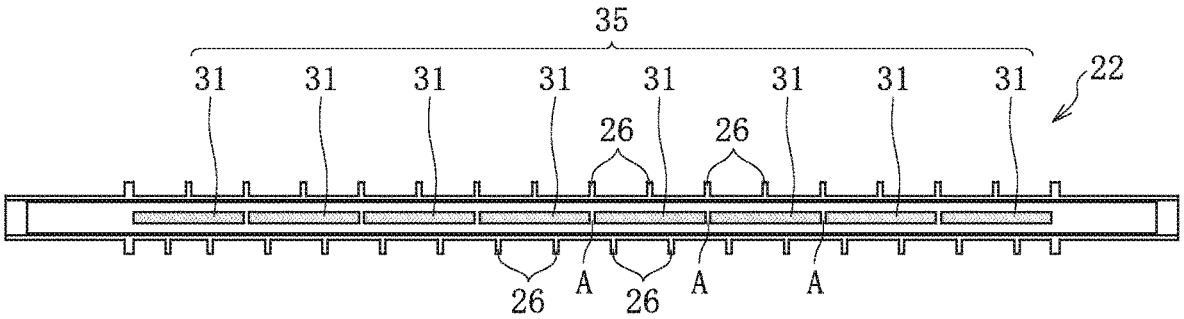
FIG. 14 is a cross-sectional view of the heater depicted in FIG. 3, illustrating upstream guides shifted from downstream guides.

According to the embodiments described above, the guides 26 disposed upstream from the heater 22 in the rotation direction of the fixing belt 20 are disposed in identical spans in the width direction of the fixing belt 20 or symmetric with the guides 26 disposed downstream from the heater 22 in the rotation direction of the fixing belt 20. Alternatively, like an example illustrated in FIG. 14, the upstream guides 26, that is, the lower guides 26 in FIG. 14, may be disposed at different positions or shifted from the downstream guides 26, that is, the upper guides 26 in FIG. 14, in the width direction of the fixing belt 20. FIG. 14 is a cross-sectional view of the heater 22, illustrating the upstream guides 26 shifted from the downstream guides 26 in the width direction of the fixing belt 20. In this case, heat is conducted from the fixing belt 20 to the upstream guides 26 at positions different from positions where heat is conducted from the fixing belt 20 to the downstream guides 26 in the width direction of the fixing belt 20, reducing the maximum amount of decrease in the temperature of the fixing belt 20 compared to a configuration in which the upstream guides 26 overlap the downstream guides 26.

According to the example illustrated in FIG. 14, each of the upstream guides 26 is shifted from the dividing region A of the heat generator 35 and each of the downstream guides 26 overlaps or is disposed opposite the dividing region A of the heat generator 35. Generally, as the fixing belt 20 rotates, the fixing belt 20 receives a pulling force that pulls the fixing belt 20 into the fixing nip N at a position upstream from the fixing nip N in the rotation direction of the fixing belt 20. Accordingly, the fixing belt 20 tends to come in contact with the upstream guides 26 with an impact or an area greater than an impact or an area with which the fixing belt 20 comes into contact with the downstream guides 26. Hence, the upstream guides 26 draw heat from the fixing belt 20 more than the downstream guides 26. In view of those circumstances, like the example depicted in FIG. 14, among the upstream guides 26 and the downstream guides 26, at least each of the upstream guides 26 that draws more heat than the downstream guides 26 is shifted from the dividing region A of the heat generator 35, reducing the maximum amount of decrease in the temperature of the fixing belt 20 effectively. Conversely, even if each of the downstream guides 26 is shifted from the dividing region A of the heat generator 35, advantages are also expected to a certain extent. In order to achieve advantages further, both the upstream guides 26 and the downstream guides 26 are preferably shifted from the dividing regions A of the heat generator 35, respectively, and the upstream guides 26 are preferably shifted from the downstream guides 26, respectively, in the width direction of the fixing belt 20.

The following describes embodiments different from the embodiments described above.

Hereinafter, the embodiments are described mainly of configurations that are different from those of the embodiments described above. A description of other configurations that are basically common to the embodiments described above is omitted.

Figure 15:
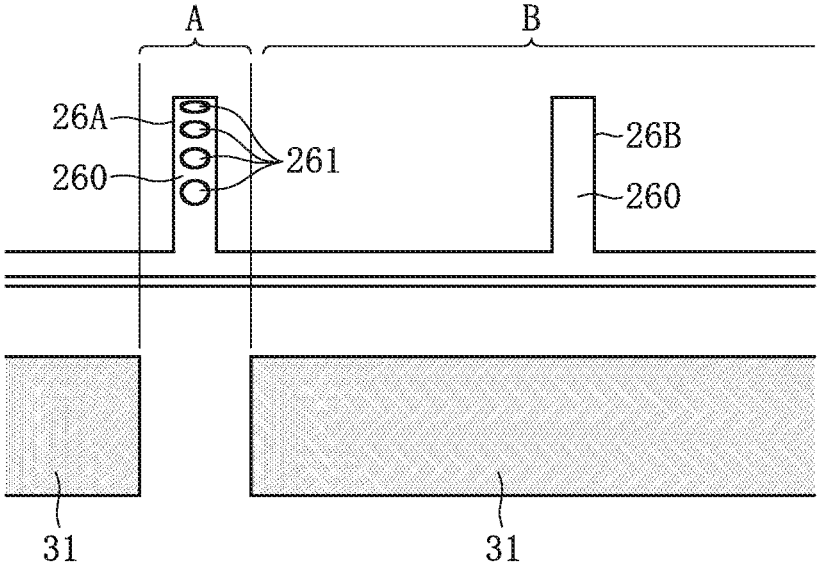
FIG. 15 is a front view of a primary guide and a secondary guide installable in the fixing device depicted in FIG. 2.
Figure 16A:
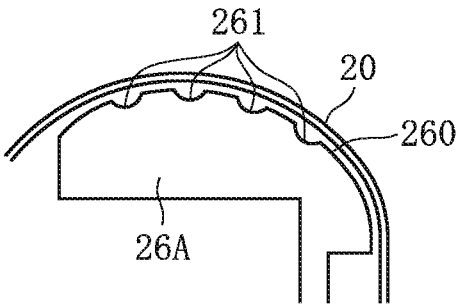
FIG. 16A is a side view of the primary guide depicted in FIG. 15.
Figure 16B:
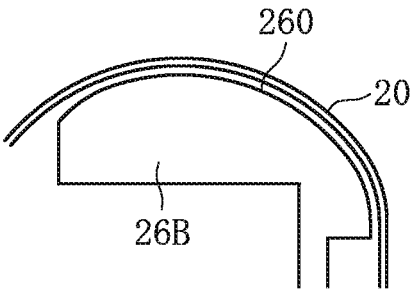
FIG. 16B is a side view of the secondary guide depicted in FIG. 15.

FIG. 15 is a front view of guides 26A and 26B according to an embodiment different from the embodiments described above. FIG. 16A is a side view of the guide 26A. FIG. 16B is a side view of the guide 26B.

According to the embodiment illustrated in FIGS. 15, 16A, and 16B, the guide 26A, that may be hereinafter referred to as a primary guide, is disposed at the position corresponding to the dividing region A of the heat generator 35 (e.g., the circumferential region of the fixing belt 20, that encompasses the dividing region A). In other words, the guide 26A is disposed opposite the dividing region A. The guide 26B, that may be hereinafter referred to as a secondary guide, is disposed at the position corresponding to the non-dividing region B of the heat generator 35 (e.g., the circumferential region of the fixing belt 20, that encompasses the non-dividing region B). In other words, the guide 26B is disposed opposite the non-dividing region B. A shape of the guide 26A is different from a shape of the guide 26B. For example, a plurality of recesses 261 is disposed on the belt opposing face 260 of the guide 26A. Conversely, the plurality of recesses 261 is not disposed on the belt opposing face 260 of the guide 26B. The belt opposing face 260 of the guide 26B is a smooth, curved face. According to this embodiment, the recess 261 is a hole having a spherical surface and having a diameter of 5 mm and a depth of 0.5 mm. Alternatively, the recess 261 may be a hole or a slit having a groove shape that extends in the circumferential direction of the fixing belt 20 or a through hole.

Since the belt opposing face 260 of the guide 26A mounts the recesses 261 as described above, the fixing belt 20 does not contact the guide 26A at the recesses 261. For example, a total contact length in the circumferential direction of the fixing belt 20 of the guide 26A that contacts the fixing belt 20 at an arbitrary position in the width direction of the fixing belt 20 is smaller than that of the guide 26B. Accordingly, an amount of heat conducted from the fixing belt 20 to the guide 26A at the position corresponding to the dividing region A of the heat generator 35 decreases, suppressing local temperature decrease of the fixing belt 20.

The total contact length in the circumferential direction of the fixing belt 20 denotes a total length of a contact portion of the guide 26A in the circumferential direction of the fixing belt 20, which may contact the fixing belt 20 at an arbitrary position in the width direction of the fixing belt 20 while the fixing belt 20 rotates. Generally, as the fixing belt 20 rotates, the fixing belt 20 vibrates, changing a rotation trajectory of the fixing belt 20. Accordingly, hereinafter, if the rotation trajectory of the fixing belt 20 changes, a total length of a maximum contact portion of the guide 26A in the circumferential direction of the fixing belt 20, which may contact the fixing belt 20 in accordance with change in the rotation trajectory of the fixing belt 20, is defined as the total contact length in the circumferential direction of the fixing belt 20.

According to the embodiment depicted in FIGS. 15, 16A, and 16B, the total contact length in the circumferential direction of the fixing belt 20 of the guide 26A that contacts the fixing belt 20 is different from that of the guide 26B. Accordingly, a contact area of the guide 26A that contacts the fixing belt 20 in the dividing region A is smaller than a contact area of the guide 26B that contacts the fixing belt 20 in the non-dividing region B. The contact area is defined similarly to the total contact length in the circumferential direction of the fixing belt 20 described above. For example, hereinafter, while the fixing belt 20 rotates, the contact area denotes a total area of a contact portion of a single guide, which may be contacted by the fixing belt 20. As described above, the contact area of the guide 26A that contacts the fixing belt 20 in the dividing region A decreases. Accordingly, the amount of heat conducted from the fixing belt 20 to the guide 26A at the position corresponding to the dividing region A of the heat generator 35 decreases, suppressing local temperature decrease of the fixing belt 20.

Figure 17:
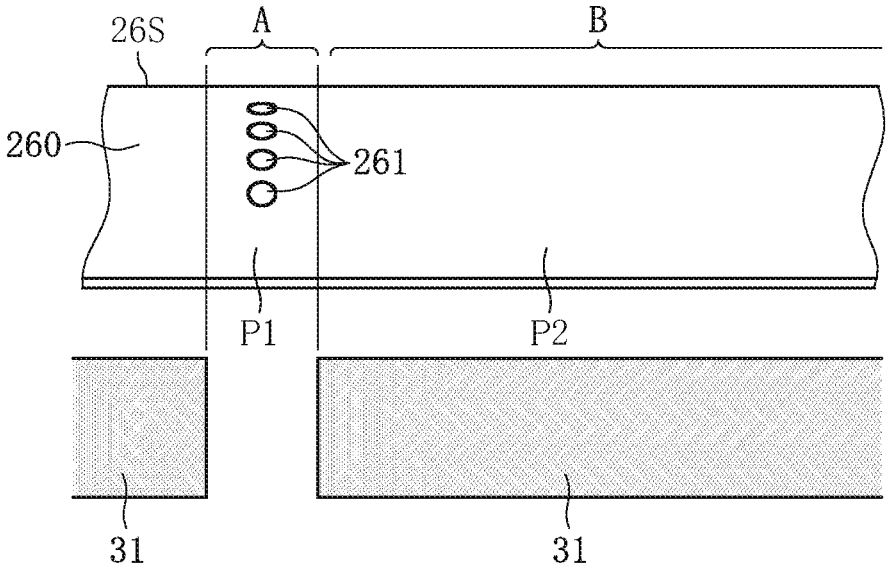
FIG. 17 is a diagram of a guide as a modification example of the primary guide and the secondary guide depicted in FIG. 15.

Referring to FIG. 17, a description is provided of a modification example of the embodiment depicted in FIGS. 15, 16A, and 16B.

FIG. 17 is a diagram of a guide 26S as the modification example of the embodiment depicted in FIG. 15.

As illustrated in FIG. 17, the guide 26S extends continuously throughout the fixing belt 20 in the width direction thereof to encompass the dividing region A and the non-dividing region B. For example, the guide 26S includes a first portion P1 serving as a primary guide disposed opposite the dividing region A and a second portion P2 serving as a secondary guide disposed opposite the non-dividing region B. The first portion P1 is contiguous to the second portion P2 in the width direction of the fixing belt 20. With a configuration of the guide 26S also, since the recesses 261 are disposed on the guide 26S in the dividing region A, the amount of heat conducted from the fixing belt 20 to the guide 26S at the position corresponding to the dividing region A of the heat generator 35 decreases similarly, suppressing local temperature decrease of the fixing belt 20.

Although FIGS. 15, 16A, and 17 illustrate the guides 26A and 26S that are disposed downstream from the heater 22 in the rotation direction of the fixing belt 20, the guides 26A and 26S that mount the recesses 261 at the position corresponding to the dividing region A may also be disposed upstream from the heater 22 in the rotation direction of the fixing belt 20 similarly. As described above, since the upstream guides 26 tend to draw heat from the fixing belt 20 more than the downstream guides 26, at least the guide 26A and the first portion P1 of the guide 26S that are disposed opposite the dividing region A and disposed upstream from the heater 22 in the rotation direction of the fixing belt 20 mount the recesses 261, suppressing local temperature decrease of the fixing belt 20 effectively.

Figure 18A:
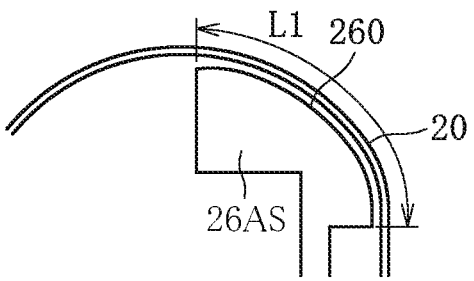
FIG. 18A is a side view of the primary guide as a variation of the primary guide depicted in FIG. 16A.
Figure 18B:
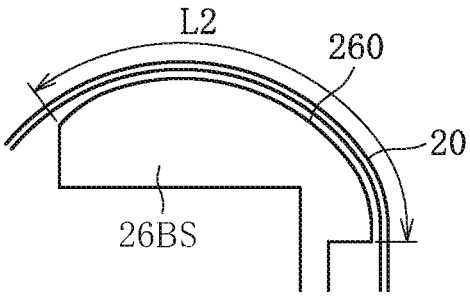
FIG. 18B is a side view of the secondary guide as a variation of the secondary guide depicted in FIG. 16B.

Referring to FIGS. 18A and 18B, a description is provided of a configuration of guides 26AS and 26BS according to another embodiment.

FIG. 18A is a side view of the guide 26AS disposed opposite the dividing region A. FIG. 18B is a side view of the guide 26BS disposed opposite the non-dividing region B.

According to the embodiment depicted in FIGS. 18A and 18B, the total contact length in the circumferential direction of the fixing belt 20 of the guide 26AS that contacts the fixing belt 20 in the dividing region A is smaller than that of the guide 26BS that contacts the fixing belt 20 in the non-dividing region B. Accordingly, a length L1 of the guide 26AS, serving as a primary guide, in the circumferential direction of the fixing belt 20 is smaller than a length L2 of the guide 26BS, serving as a secondary guide, in the circumferential direction of the fixing belt 20. Additionally, according to this embodiment, since a width of the guide 26AS is identical to a width of the guide 26BS in the width direction of the fixing belt 20, the belt opposing face 260 of the guide 26AS is smaller than the belt opposing face 260 of the guide 26BS.

Accordingly, the contact area of the guide 26AS that contacts the fixing belt 20 in the dividing region A is smaller than the contact area of the guide 26BS that contacts the fixing belt 20 in the non-dividing region B. Accordingly, the amount of heat conducted from the fixing belt 20 to the guide 26AS at the position corresponding to the dividing region A decreases compared to the amount of heat conducted from the fixing belt 20 to the guide 26BS at the position corresponding to the non-dividing region B, suppressing local temperature decrease of the fixing belt 20.

Although FIGS. 18A and 18B illustrate the guides 26AS and 26BS that are disposed downstream from the heater 22 in the rotation direction of the fixing belt 20, the guides 26AS and 26BS that have the length L1 in the dividing region A and the length L2 that is greater than the length L1 in the circumferential direction of the fixing belt 20, respectively, may also be disposed upstream from the heater 22 in the rotation direction of the fixing belt 20 similarly. As described above, since the upstream guides 26 tend to draw heat from the fixing belt 20 more than the downstream guides 26, at least the guides 26AS disposed opposite the dividing region A and disposed upstream from the heater 22 in the rotation direction of the fixing belt 20 have the length L1 in the circumferential direction of the fixing belt 20 that is smaller than the length L2 of the guides 26BS disposed opposite the non-dividing region B, suppressing local temperature decrease of the fixing belt 20 effectively. Alternatively, the guides 26AS and 26BS according to this embodiment are also applied to a guide that extends continuously throughout the fixing belt 20 in the width direction thereof.

According to the above-described embodiments depicted in FIGS. 15, 16A, 16B, 17, 18A, and 18B, the guides 26A and 26S mount the recesses 261 or the guide 26AS has the length L1 in the circumferential direction of the fixing belt 20, which is smaller than the length L2 of the guide 26BS. Accordingly, the total contact length in the circumferential direction of the fixing belt 20 or the contact area of the guides 26A, 26S, and 26AS that contact the fixing belt 20 in the dividing region A decreases, suppressing local temperature decrease of the fixing belt 20. Conversely, according to the embodiments depicted in FIG. 8 and the like, since the guide 26 is not disposed opposite the dividing region A, the total contact length in the circumferential direction of the fixing belt 20 or the contact area of the guide 26 that contacts the fixing belt 20 in the dividing region A does not generate. However, according to the embodiments depicted in FIG. 8 and the like also, if the total contact length in the circumferential direction of the fixing belt 20 of the guide 26 that contacts the fixing belt 20 is compared between the dividing region A where the guide 26 is not disposed opposite the heat generator 35 and the non-dividing region B where the guide 26 is disposed opposite the heat generator 35, the total contact length in the circumferential direction of the fixing belt 20 of the guide 26 that contacts the fixing belt 20 in the dividing region A is smaller than that of the guide 26 that contacts the fixing belt 20 in the non-dividing region B or zero. Otherwise, the contact area of the guide 26 that contacts the fixing belt 20 in the dividing region A is smaller than that of the guide 26 that contacts the fixing belt 20 in the non-dividing region B or zero. Accordingly, a definition in the present disclosure that the total contact length in the circumferential direction of the fixing belt 20 is smaller or decreases also denotes a case in which the total contact length in the circumferential direction of the fixing belt 20 does not generate. A definition that the contact area of the guide 26 that contacts the fixing belt 20 is smaller or decreases also denotes a case in which the contact area of the guide 26 that contacts the fixing belt 20 does not generate.

According to the embodiment depicted in FIGS. 18A and 18B, the length L1 of the guide 26AS in the circumferential direction of the fixing belt 20 decreases to reduce the contact area where the guide 26AS contacts the fixing belt 20. Seen from another point of view, a size (e.g., a volume) of the guide 26AS is smaller than that of the guide 26BS, decreasing the thermal capacity of the guide 26AS. As a result, the amount of heat conducted from the fixing belt 20 to the guide 26AS decreases. As a configuration that decreases the contact area or the thermal capacity of the guide 26AS that contacts the fixing belt 20 in the dividing region A more than the non-dividing region B, an embodiment described below with reference to FIG. 19 is employed other than the embodiment illustrated in FIGS. 18A and 18B.

Figure 19:
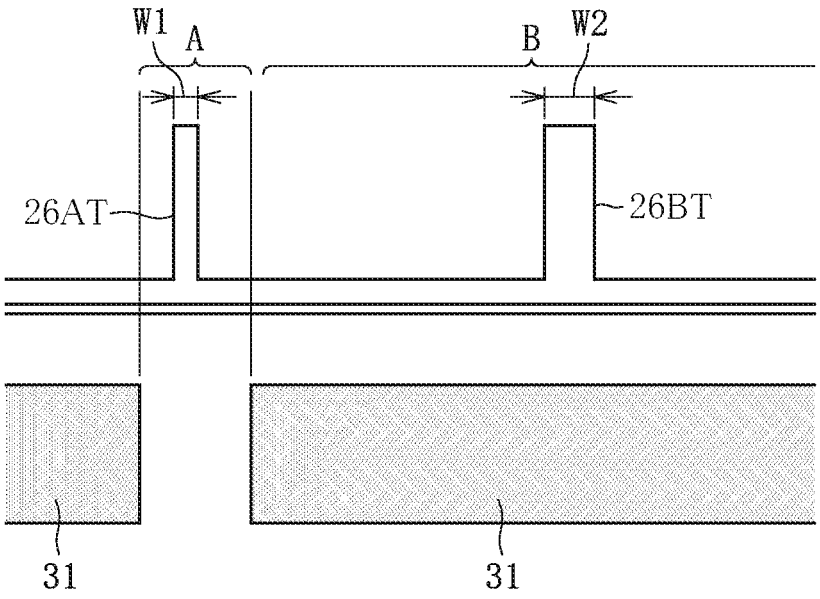
FIG. 19 is a diagram of the primary guide and the secondary guide as another variation of the primary guide and the secondary guide depicted in FIG. 15.

FIG. 19 is a diagram of guides 26AT and 26BT, illustrating a width of the guide 26AT, which is smaller than a width of the guide 26BT. According to the embodiment depicted in FIG. 19, the width of the guide 26AT is different from the width of the guide 26BT. For example, as illustrated in FIG. 19, a width W1 of the guide 26AT serving as a primary guide is smaller than a width W2 of the guide 26BT serving as a secondary guide in the width direction of the fixing belt 20. Accordingly, the belt opposing face 260 of the guide 26AT at the position corresponding to the dividing region A is downsized. As a result, the contact area of the guide 26AT that contacts the fixing belt 20 in the dividing region A decreases. Additionally, since the width W1 of the guide 26AT is smaller than the width W2 of the guide 26BT, a size (e.g., a volume) of the guide 26AT is smaller than that of the guide 26BT, decreasing the thermal capacity of the guide 26AT disposed opposite the dividing region A. Accordingly, the amount of heat conducted from the fixing belt 20 to the guide 26AT at the position corresponding to the dividing region A decreases compared to the amount of heat conducted from the fixing belt 20 to the guide 26BT at the position corresponding to the non-dividing region B, suppressing temperature decrease of the fixing belt 20 at the position corresponding to the dividing region A.

Although FIG. 19 also illustrates the guides 26AT and 26BT that are disposed downstream from the heater 22 in the rotation direction of the fixing belt 20, the guides 26AT and 26BT that have the width W1 in the dividing region A and the width W2 that is greater than the width W1 in the non-dividing region B, respectively, may also be disposed upstream from the heater 22 in the rotation direction of the fixing belt 20 similarly. As described above, since the upstream guides 26 tend to draw heat from the fixing belt 20 more than the downstream guides 26, at least each of the guides 26AT disposed opposite the dividing region A and disposed upstream from the heater 22 in the rotation direction of the fixing belt 20 has the width W1 smaller than the width W2 of each of the guides 26BT disposed opposite the non-dividing region B in the width direction of the fixing belt 20, suppressing local temperature decrease of the fixing belt 20 effectively.

As described above, according to the embodiments illustrated in FIGS. 18A, 18B, and 19, the length L1 of the guide 26AS or the width W1 of the guide 26AT in the dividing region A is smaller than the length L2 of the guide 26BS or the width W2 of the guide 26BT in the non-dividing region B, decreasing the thermal capacity of the guides 26AS and 26AT and decreasing the amount of heat conducted from the fixing belt 20 to the guides 26AS and 26AT. Conversely, according to the above-described embodiments illustrated in FIG. 8 and the like, since the guide 26 is not disposed opposite the dividing region A, the thermal capacity of the guide 26 does not generate at the position corresponding to the dividing region A. However, according to the embodiments depicted in FIG. 8 and the like also, if the thermal capacity of the guide 26 that contacts the fixing belt 20 is compared between the dividing region A where the guide 26 is not disposed opposite the heat generator 35 and the non-dividing region B where the guide 26 is disposed opposite the heat generator 35, the thermal capacity of the guide 26 that contacts the fixing belt 20 in the dividing region A is smaller than that of the guide 26 that contacts the fixing belt 20 in the non-dividing region B or zero. Accordingly, a definition in the present disclosure that the thermal capacity of the guide is smaller or decreases also denotes a case in which the thermal capacity of the guide does not generate.

The embodiments described above explain solutions to prevent local temperature decrease of the fixing belt 20, which is caused by arrangement of the dividing region A of the heat generator 35 and the guide 26 depicted in FIG. 7. However, local temperature decrease of the fixing belt 20 may result from conduction of heat from the fixing belt 20 to the thermistors 25 and the thermostat 27 depicted in FIG. 5 that contact the heater 22 other than arrangement of the dividing region A of the heat generator 35 and the guide 26.

Figure 20:
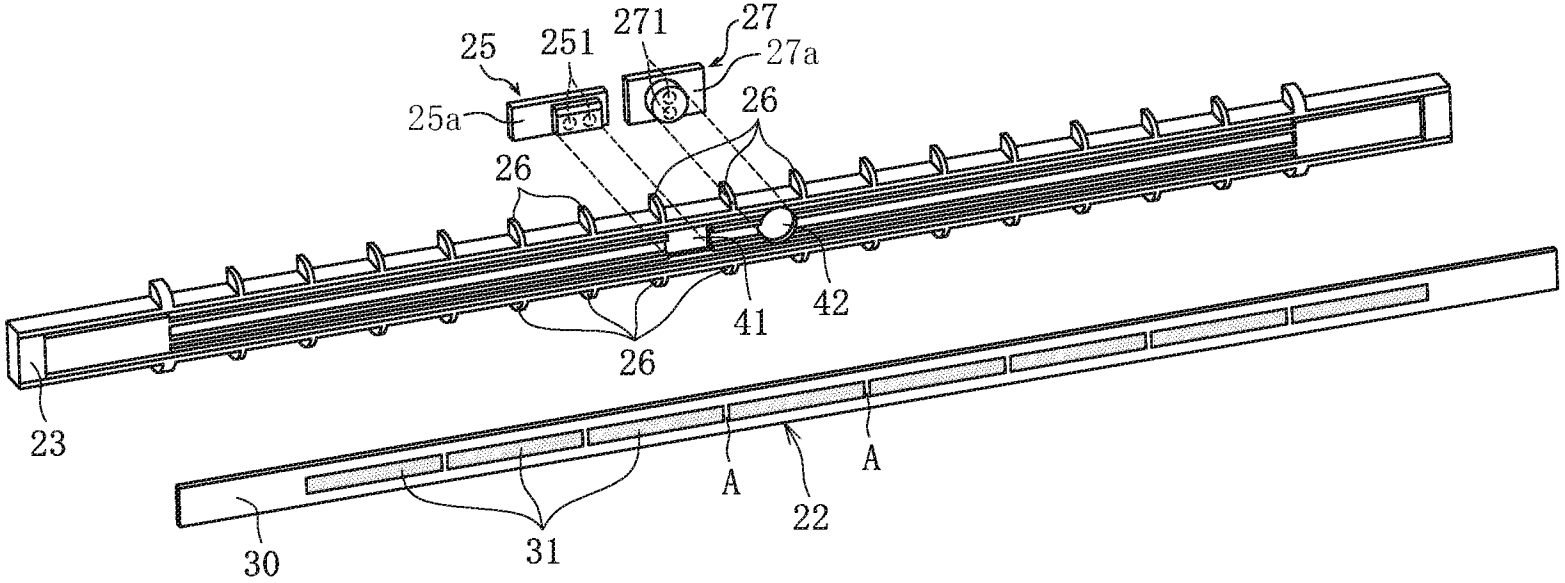
FIG. 20 is a perspective view of the heater and the guides depicted in FIG. 3, illustrating arrangement of a thermistor and a thermostat.

To address this circumstance, in order to suppress local temperature decrease of the fixing belt 20 caused by conduction of heat from the fixing belt 20 to the thermistors 25 and the thermostat 27, an embodiment illustrated in FIG. 20 is employed. FIG. 20 is a perspective view of the heater 22 and the guides 26, illustrating arrangement of the thermistor 25 and the thermostat 27. According to the embodiment illustrated in FIG. 20, a slot 41 through which the thermistor 25 is attached the heater holder 23 and a slot 42 through which the thermostat 27 is attached to the heater holder 23 are shifted from the guides 26, respectively, in the width direction of the fixing belt 20. For example, a contact position where each of the thermistor 25 and the thermostat 27 contacts the heater 22 is shifted from the guide 26 in the width direction of the fixing belt 20. Accordingly, heat is conducted from the fixing belt 20 to the thermistor 25 and the thermostat 27 at positions different from positions where heat is conducted from the fixing belt 20 to the guides 26 in the width direction of the fixing belt 20, reducing the maximum amount of decrease in the temperature of the fixing belt 20 compared to a configuration in which the thermistor 25 and the thermostat 27 overlap the guides 26.

The contact position where each of the thermistor 25 and the thermostat 27 contacts the heater 22 is also preferably shifted from the dividing region A of the heat generator 35 in the width direction of the fixing belt 20. Accordingly, the thermistor 25 and the thermostat 27 do not overlap the dividing region A of the heat generator 35, also suppressing local temperature decrease of the fixing belt 20.

Additionally, a recess 251 is mounted on a contact face 25*a* of the thermistor 25, which contacts the heater 22. A recess 271 is mounted on a contact face 27*a* of the thermostat 27, which contacts the heater 22. Accordingly, a contact area where the thermistor 25 and the thermostat 27 contact the heater 22 decreases, reducing an amount of heat conducted from the heater 22 to the thermistor 25 and the thermostat 27 and thereby suppressing local temperature decrease of the fixing belt 20. The recesses 251 and 271 are preferably employed for a configuration in which the contact position where each of the thermistor 25 and the thermostat 27 contacts the heater 22 overlaps at least one of the guide 26 and the dividing region A of the heat generator 35 in the width direction of the fixing belt 20.

Other than the configuration in which the thermistor 25 and the thermostat 27 contact the heater 22 directly, the thermistor 25 and the thermostat 27 may contact the fixing belt 20. In this case also, the contact position where each of the thermistor 25 and the thermostat 27 contacts the fixing belt 20 is shifted from the guide 26 or the dividing region A of the heat generator 35 in the width direction of the fixing belt 20 or the contact faces 25*a* and 27*a* of the thermistor 25 and the thermostat 27, which contact the fixing belt 20, mount the recesses 251 and 271, respectively, thus attaining the advantages described above.

The above describes the embodiments of the present disclosure. However, the embodiments of the present disclosure may be modified variously within the scope of the present disclosure. For example, the embodiments and the modification examples thereof described above may be combined properly.

The embodiments are described above with the image forming apparatus 100 as a color image forming apparatus that forms a color toner image as an example. Alternatively, the image forming apparatus 100 according to the embodiments of the present disclosure may be a monochrome image forming apparatus that forms a monochrome toner image. The image forming apparatus 100 according to the embodiments of the present disclosure is a printer, a copier, a facsimile machine, a multifunction peripheral (MFP) having at least two of printing, copying, facsimile, scanning, and plotter functions, or the like.

Figure 21:
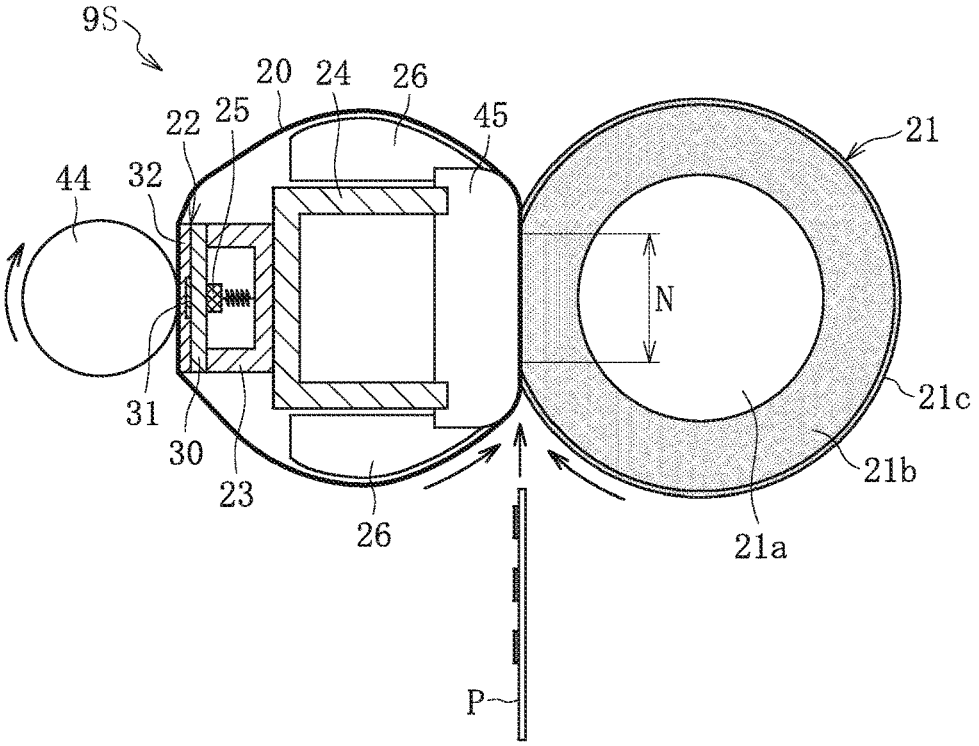
FIG. 21 is a schematic cross-sectional view of a fixing device according to a second embodiment of the present disclosure, that is installable in the image forming apparatus depicted in FIG. 1.
Figure 22:
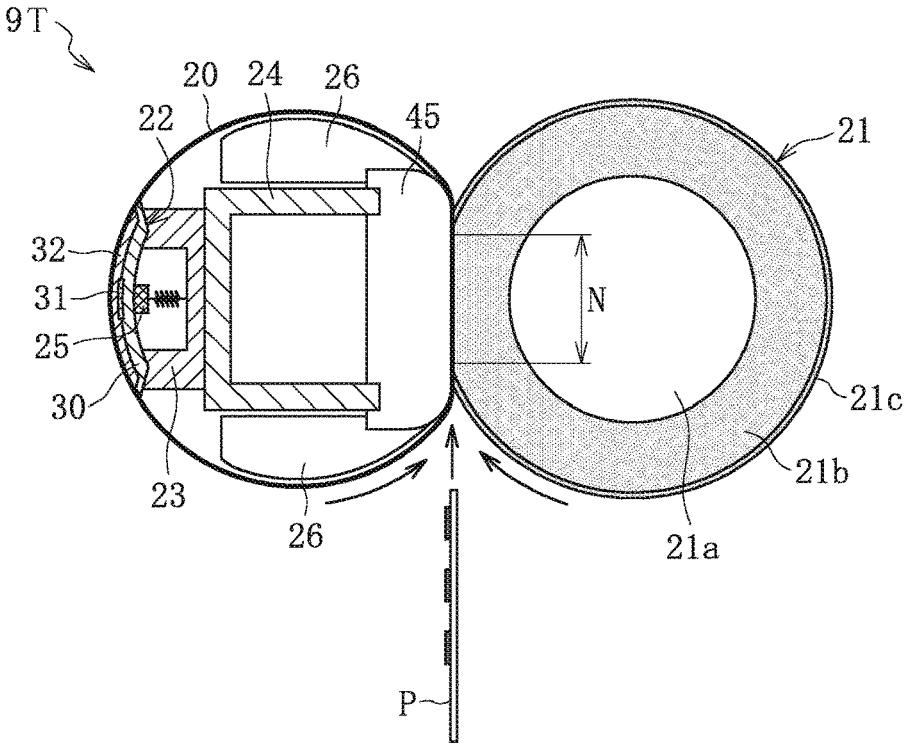
FIG. 22 is a schematic cross-sectional view of a fixing device according to a third embodiment of the present disclosure, that is installable in the image forming apparatus depicted in FIG. 1.
Figure 23:
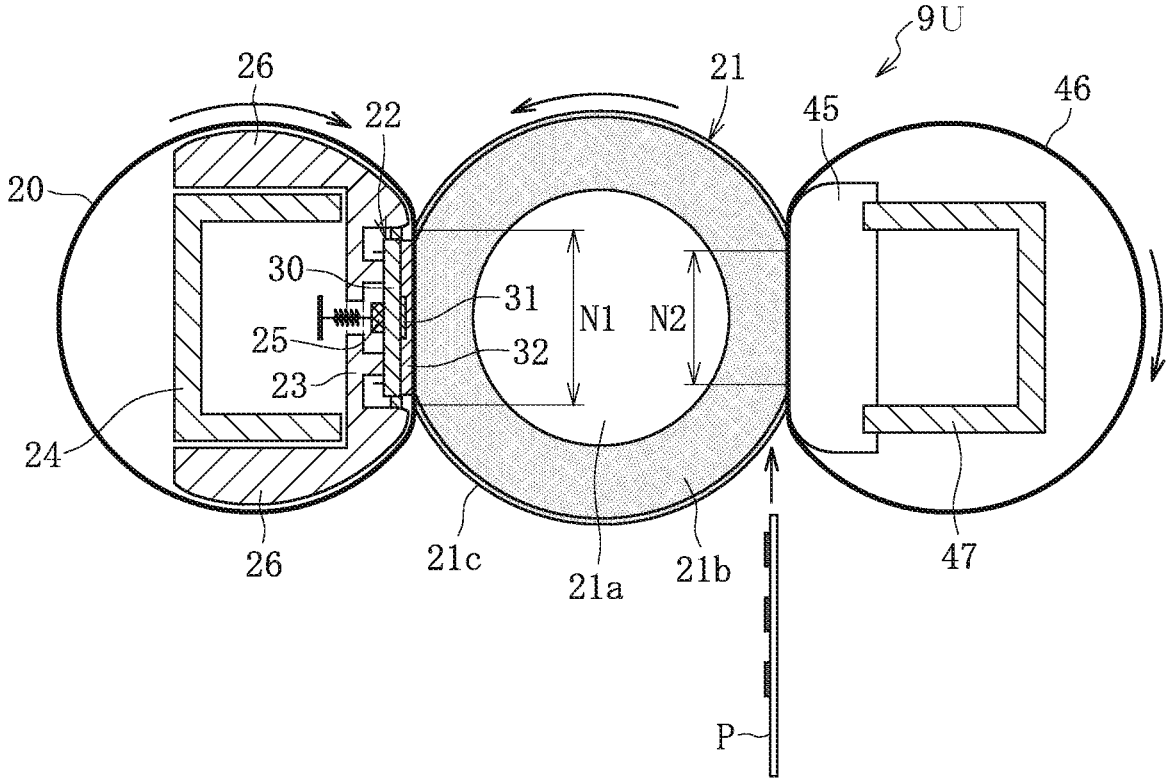
FIG. 23 is a schematic cross-sectional view of a fixing device according to a fourth embodiment of the present disclosure, that is installable in the image forming apparatus depicted in FIG. 1.

The embodiments of the present disclosure are applicable to fixing devices 9S, 9T, and 9U illustrated in FIGS. 21, 22, and 23, respectively, other than the fixing device 9 illustrated in FIG. 2, for example.

The following briefly describes a construction of each of the fixing devices 9S, 9T, and 9U depicted in FIGS. 21, 22, and 23, respectively.

A description is provided of the construction of the fixing device 9S.

FIG. 21 is a schematic cross-sectional view of the fixing device 9S. As illustrated in FIG. 21, the fixing device 9S includes a pressing roller 44 disposed opposite the pressure roller 21 via the fixing belt 20. The pressing roller 44 and the heater 22 sandwich the fixing belt 20 such that the heater 22 heats the fixing belt 20. On the other hand, a nip forming pad 45 is disposed inside the loop formed by the fixing belt 20 and disposed opposite the pressure roller 21. The stay 24 supports the nip forming pad 45. The nip forming pad 45 and the pressure roller 21 sandwich the fixing belt 20 and define the fixing nip N. The nip forming pad 45 mounts the guides 26 that guide the fixing belt 20.

A description is provided of the construction of the fixing device 9T.

FIG. 22 is a schematic cross-sectional view of the fixing device 9T. As illustrated in FIG. 22, the fixing device 9T does not include the pressing roller 44 depicted in FIG. 21. In order to attain a contact length for which the heater 22 contacts the fixing belt 20 in the circumferential direction thereof, the heater 22 is curved into an arc in cross-section that corresponds to a curvature of the fixing belt 20. Other construction of the fixing device 9T is equivalent to that of the fixing device 9S depicted in FIG. 21.

A description is provided of the construction of the fixing device 9U.

FIG. 23 is a schematic cross-sectional view of the fixing device 9U. As illustrated in FIG. 23, the fixing device 9U includes a pressure belt 46 in addition to the fixing belt 20. The pressure belt 46 and the pressure roller 21 form a fixing nip N2 serving as a secondary nip separately from a heating nip N1 serving as a primary nip formed between the fixing belt 20 and the pressure roller 21. For example, the nip forming pad 45 and a stay 47 are disposed opposite the fixing belt 20 via the pressure roller 21. The pressure belt 46 that is rotatable accommodates the nip forming pad 45 and the stay 47. As a sheet P bearing a toner image is conveyed through the fixing nip N2 formed between the pressure belt 46 and the pressure roller 21, the pressure belt 46 and the pressure roller 21 fix the toner image on the sheet P under heat and pressure. Other construction of the fixing device 9U is equivalent to that of the fixing device 9 depicted in FIG. 2.

As described above, according to the embodiments of the present disclosure, the amount of heat conducted from the fixing belt 20 to the guide (e.g., the guides 26, 26A, 26S, 26AS, and 26AT) decreases or is zero at the position corresponding to the dividing region A of the heat generator 35, thus suppressing local temperature decrease of the fixing belt 20 at the position corresponding to the dividing region A. Additionally, according to the embodiments of the present disclosure, since a simple design change suppresses local temperature decrease of the fixing belt 20, the fixing belt 20 is not heated for the extended period of time to increase the temperature of the fixing belt 20 entirely. Thus, the fixing belt 20 is not heated for the extended period of time, preventing extension of the warmup time, increase in consumption of power, hot offset, and the like, and attaining the appropriate fixing property.

A description is provided of advantages of the fixing devices 9, 9S, 9T, and 9U.

As illustrated in FIGS. 2, 21, 22, and 23, a fixing device (e.g., the fixing devices 9, 9S, 9T, and 9U) includes an endless belt (e.g., the fixing belt 20), an opposed rotator (e.g., the pressure roller 21), a heater (e.g., the heater 22), a primary guide (e.g., the guides 26, 26A, 26S, 26AS, and 26AT), and a secondary guide (e.g., the guides 26, 26B, 26S, 26BS, and 26BT). The endless belt rotates in a rotation direction, that is, a circumferential direction. The opposed rotator contacts an outer circumferential surface of the endless belt to form a nip (e.g., the fixing nip N and the heating nip N1) therebetween. The heater contacts an inner circumferential surface of the endless belt.

As illustrated in FIG. 8, the heater includes a heat generator (e.g., the heat generator 35) that is divided into a plurality of heat generating portions (e.g., the resistive heat generators 31) in an axial direction (e.g., a width direction) of the endless belt. The heat generator defines a dividing region (e.g., the dividing region A) between adjacent ones of the plurality of heat generating portions and a non-dividing region (e.g., the non-dividing region B) other than the dividing region. The primary guide and the secondary guide contact the inner circumferential surface of the endless belt and guide the endless belt. The primary guide is disposed opposite the dividing region of the heat generator and has a first thermal capacity. The secondary guide is disposed opposite the non-dividing region of the heat generator and has a second thermal capacity that is greater than the first thermal capacity.

According to the embodiments of the present disclosure, the first thermal capacity of the primary guide disposed opposite the dividing region of the heat generator is smaller than the second thermal capacity of the secondary guide disposed opposite the non-dividing region. Accordingly, an amount of heat conducted from the endless belt to the primary guide disposed opposite the dividing region of the heat generator decreases, suppressing local temperature decrease of the endless belt at a position corresponding to the dividing region.

According to the embodiments described above, the fixing belt 20 serves as an endless belt. Alternatively, a fixing film, a fixing sleeve, or the like may be used as an endless belt. Further, the pressure roller 21 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

an endless belt configured to rotate in a rotation direction;

an opposed rotator configured to contact an outer circumferential surface of the endless belt to form a nip between the endless belt and the opposed rotator;

a heater configured to contact an inner circumferential surface of the endless belt, the heater including a heat generator divided into a plurality of heat generating portions in an axial direction of the endless belt, the heat generator having a dividing region between adjacent ones of the plurality of heat generating portions and a non-dividing region other than the dividing region; and a guide configured to contact the inner circumferential surface of the endless belt to guide the endless belt, the guide including at least a first guide configured to guide a first portion of the endless belt corresponding to the non-dividing region of the heat generator.

2. The fixing device according to claim 1, further comprises:

a second guide configured to guide a second portion of the endless belt corresponding to the dividing region of the heat generator.

3. A fixing device comprising:

an endless belt configured to rotate in a rotation direction;

an opposed rotator configured to contact an outer circumferential surface of the endless belt to form a nip between the endless belt and the opposed rotator;

a heater configured to contact an inner circumferential surface of the endless belt, the heater including a heat generator divided into a plurality of heat generating portions in an axial direction of the endless belt, the heat generator defining a dividing region between adjacent ones of the plurality of heat generating portions and a non-dividing region other than the dividing region; and a guide configured to contact the inner circumferential surface of the endless belt to guide the endless belt, the guide including, a primary guide opposite the dividing region of the heat generator, and a secondary guide opposite the non-dividing region of the heat generator.

4. The fixing device of claim 3, wherein the primary guide has a first thermal capacity, and the secondary guide has a second thermal capacity, the second thermal capacity being greater than the first thermal capacity.

5. The fixing device according to claim 4, wherein the primary guide includes a first belt opposing face opposite the inner circumferential surface of the endless belt, wherein the secondary guide includes a second belt opposing face opposite the inner circumferential surface of the endless belt, and wherein the first belt opposing face is smaller than the second belt opposing face.

6. The fixing device according to claim 3, wherein the primary guide is configured to contact the inner circumferential surface of the endless belt with a first total contact length in the rotation direction of the endless belt at a set position in the axial direction of the endless belt, wherein the secondary guide is configured to contact the inner circumferential surface of the endless belt with a second total contact length in the rotation direction of the endless belt at the set position in the axial direction of the endless belt, and wherein the first total contact length is smaller than the second total contact length.

7. The fixing device according to claim 3, wherein the primary guide has a first length in the rotation direction of the endless belt, wherein the secondary guide has a second length in the rotation direction of the endless belt, and wherein the first length is smaller than the second length.

8. The fixing device according to claim 3, wherein the primary guide and the secondary guide are separated in the axial direction of the endless belt by an interval, wherein the primary guide has a first width in the axial direction of the endless belt and the secondary guide has a second width in the axial direction of the endless belt, and wherein the first width is smaller than the second width.

9. The fixing device according to claim 3, wherein the primary guide is contiguous to the secondary guide in the axial direction of the endless belt.

10. An image forming apparatus comprising:

the fixing device according to claim 3.

11. The fixing device according to claim 3, wherein a shape of the primary guide is different from a shape of the secondary guide.

12. The fixing device according to claim 3, wherein the primary guide includes a first belt opposing face opposite the inner circumferential surface of the endless belt, the first belt opposing face having recesses therein.

13. The fixing device according to claim 12, wherein at least one of the recesses in the first belt opposing face is spherical.

14. The fixing device according to claim 12, wherein at least one of the recesses in the first belt opposing face is a hole.

15. The fixing device according to claim 12, wherein at least one of the recesses in the first belt opposing face is a slit.

16. The fixing device according to claim 15, wherein the slit extends in a circumferential direction of the endless belt.

17. The fixing device according to claim 3, wherein the secondary guide includes a second belt opposing face opposite the inner circumferential surface of the endless belt, the second belt opposing face being curved.

18. The fixing device according to claim 3, wherein the guide is a continuous guide that extends continuously in the axial direction of the endless belt such that a portion of the continuous guide opposite to the dividing region defines the primary guide and a portion of the continuous guide opposite to the non-dividing region defines the secondary guide.

19. The fixing device of claim 3, wherein the primary guide and the secondary guide are each configured to contact the inner circumferential surface of the endless belt such that a first contact area in which the primary guide contacts the inner circumferential surface is less than a second contact area in which the secondary guide contacts the inner circumferential surface.

20. A fixing device comprising:

an endless belt configured to rotate in a rotation direction;

an opposed rotator configured to contact an outer circumferential surface of the endless belt to form a nip between the endless belt and the opposed rotator;

a heater configured to contact an inner circumferential surface of the endless belt, the heater including a heat generator divided into a plurality of heat generating portions in an axial direction of the endless belt, the heat generator defining a dividing region between adjacent ones of the plurality of heat generating portions and a non-dividing region other than the dividing region;

a primary guide configured to contact the inner circumferential surface of the endless belt to guide the endless belt; and a secondary guide configured to contact the inner circumferential surface of the endless belt to guide the endless belt, wherein the primary guide and the secondary guide are at one of an upstream position upstream from the heater and a downstream position downstream from the heater in the rotation direction of the endless belt, the primary guide and the secondary guide are within an axial span of the endless belt and shifted from a center of the dividing region in the axial direction of the endless belt.

21. The fixing device according to claim 20, wherein the primary guide and the secondary guide are shifted from the dividing region in the axial direction of the endless belt.

22. The fixing device according to claim 20, further comprising:

another primary guide at another one of the upstream position and the downstream position; and another secondary guide at another one of the upstream position and the downstream position, wherein said another primary guide and said another secondary guide are shifted from the primary guide and the secondary guide in the axial direction of the endless belt.

23. The fixing device according to claim 20, further comprising:

a temperature detector, configured to detect a temperature of the one of the heater and the endless belt from a detector contact position, wherein the detector contact position is shifted from at least one of the primary guide, the secondary guide, and the dividing region in the axial direction of the endless belt.

24. The fixing device according to claim 23, wherein the temperature detector includes:

a detector contact face configured to contact one of the heater and the endless belt at the detector contact face; and a detector recess mounted on the detector contact face.

25. The fixing device according to claim 20, further comprising:

a power interrupter configured to interrupt a power supply to the heater when a temperature of the one of the heater and the endless belt at an interrupter contact positon is greater than or equal to a set temperature, wherein the interrupter contact position is shifted from at least one of the primary guide, the secondary guide, and the dividing region in the axial direction of the endless belt.

26. The fixing device according to claim 25, wherein the power interrupter includes:

an interrupter contact face configured to contact one of the heater and the endless belt at the interrupter contact positon; and an interrupter recess mounted on the interrupter contact face.

27. A heater holder configured to support a heater of a fixing device, the heater holder comprising:

a mounting portion configured to support the heater such that the heater is configured to contact an inner circumferential surface of an endless belt, the heater including a heat generator divided into a plurality of heat generating portions in an axial direction of the endless belt; and a guide configured to contact the inner circumferential surface of the endless belt to guide the endless belt, the guide including, a primary guide opposite a dividing region of the heat generator between adjacent ones of the plurality of heat generating portions, and a secondary guide opposite a non-dividing region of the heat generator other than the dividing region.

28. The heater holder of claim 27, wherein a shape of the primary guide is different from a shape of the secondary guide.

29. A fixing device comprising:

an endless belt to rotate in a rotation direction;

an opposed rotator to contact an outer circumferential surface of the endless belt to form a nip between the endless belt and the opposed rotator;

a heater contacting an inner circumferential surface of the endless belt, the heater including a heat generator that is divided into a plurality of heat generating portions in an axial direction of the endless belt, the heat generator defining a dividing region between adjacent ones of the plurality of heat generating portions and a non-dividing region other than the dividing region;

a primary guide, contacting the inner circumferential surface of the endless belt, to guide the endless belt, the primary guide being disposed opposite the dividing region of the heat generator and having a first thermal capacity; and a secondary guide, contacting the inner circumferential surface of the endless belt, to guide the endless belt, the secondary guide being disposed opposite the non-dividing region of the heat generator and having a second thermal capacity that is greater than the first thermal capacity.

30. A fixing device comprising:

an endless belt to rotate in a rotation direction;

an opposed rotator to contact an outer circumferential surface of the endless belt to form a nip between the endless belt and the opposed rotator;

a heater contacting an inner circumferential surface of the endless belt, the heater including a heat generator that is divided into a plurality of heat generating portions in an axial direction of the endless belt, the heat generator defining a dividing region between adjacent ones of the plurality of heat generating portions and a non-dividing region other than the dividing region;

a primary guide, contacting the inner circumferential surface of the endless belt in a first contact area, to guide the endless belt, the primary guide being disposed opposite the dividing region of the heat generator; and a secondary guide, contacting the inner circumferential surface of the endless belt in a second contact area that is greater than the first contact area, to guide the endless belt, the secondary guide being disposed opposite the non-dividing region of the heat generator.

* * * * *